US008199099B2

(12) United States Patent
Kwon et al.

(10) Patent No.: US 8,199,099 B2
(45) Date of Patent: Jun. 12, 2012

(54) APPARATUS AND METHOD FOR DRIVING LIQUID CRYSTAL DISPLAY DEVICE

(75) Inventors: Sun Young Kwon, Gumi-si (KR); Do Heon Kim, Basan (KR); Su Hwan Moon, Gumi (KR); Ji Eun Chae, Gumi (KR)

(73) Assignee: LG Display Co., Ltd, Seoul (KR)

( * ) Notice: Subject to any disclaimer, the term of this patent is extended or adjusted under 35 U.S.C. 154(b) by 393 days.

(21) Appl. No.: 12/535,418

(22) Filed: Aug. 4, 2009

(65) Prior Publication Data

US 2009/0295784 A1 Dec. 3, 2009

Related U.S. Application Data

(62) Division of application No. 11/208,417, filed on Aug. 19, 2005, now Pat. No. 7,586,476.

(30) Foreign Application Priority Data

Jun. 15, 2005 (KR) ..... 10-2005-0051395
Jun. 29, 2005 (KR) ..... 10-2005-0057002

(51) Int. Cl.
*G09G 3/36* (2006.01)

(52) U.S. Cl. ..... 345/100; 345/87; 345/94; 345/96

(58) Field of Classification Search ..... 345/87–100, 345/209

See application file for complete search history.

(56) References Cited

U.S. PATENT DOCUMENTS 5,568,163 A 10/1996 Okumura
6,445,372 B1 * 9/2002 Asai ..... 345/99
2003/0038766 A1 * 2/2003 Lee et al. ..... 345/87
2004/0008170 A1 1/2004 Makino et al.
2004/0095308 A1 5/2004 Kim et al.
2004/0196232 A1 * 10/2004 Kim et al. ..... 345/89
2004/0217142 A1 11/2004 Jeon et al.
2005/0104826 A1 * 5/2005 Baek et al. ..... 345/87
2005/0174310 A1 8/2005 Huang et al.

FOREIGN PATENT DOCUMENTS

JP 2000-221474 8/2000
KR 10-2003-0026589 A 4/2003
KR 10-2005-0000105 A 1/2005
TW 456840 3/2001
TW 521229 2/2003

OTHER PUBLICATIONS

Office Action issued in corresponding Taiwanese Patent Application No. 094132492; issued Feb. 19, 2009.

Office Action issued in corresponding Korean Patent Application No. 2011-045927599, mailed Aug. 17, 2011.

* cited by examiner

*Primary Examiner* — Amare Mengistu
*Assistant Examiner* — Koosha Sharifi-Tafreshi
(74) *Attorney, Agent, or Firm* — Brinks Hofer Gilson & Lione

(57) ABSTRACT

An apparatus and method for driving a liquid crystal display device are disclosed. The apparatus includes a liquid crystal panel with pixels defined by data and gate lines. A gate driver provides different gate pulses to the odd-column pixels than to the even-column pixels. The gate pulses have different voltages and/or widths. Data drivers provide data voltages having a positive or negative polarity to the data lines. A timing controller controls the gate and data drivers and supplies gate clock pulses that have different voltages and/or widths to the gate driver.

11 Claims, 16 Drawing Sheets

APPARATUS AND METHOD FOR DRIVING LIQUID CRYSTAL DISPLAY DEVICE

This application claims the benefit of U.S. patent application Ser. No. 11/208,417, filed on Aug. 19, 2005, which claims the benefit of Korean Patent Application Nos. P2005-51395 filed on Jun. 15, 2005, P2005-57002 filed on Jun. 29, 2005, all of which are hereby incorporated by reference as if fully set forth herein.

FIELD OF THE INVENTION

The present invention relates to a liquid crystal display device, and more particularly, to an apparatus and method for driving a liquid crystal display device, in which vertical dimming is minimized to improve picture quality.

DISCUSSION OF THE RELATED ART

In recent years, various flat panel display devices, which have advantages over cathode ray tubes in terms of weight and size, conventional weaknesses of cathode ray tubes, have entered into widespread use. These flat panel display devices include liquid crystal displays, field emission displays, plasma display panels, and light emitting displays.

Among these flat panel display devices displays, a liquid crystal displays (LCD) device an image by controlling light transmittance of a liquid crystal.

To this end, an active matrix type LCD is known which uses a thin film transistor (TFT) as a switching element. The active matrix type LCD comprises a TFT array substrate, a facing substrate placed a predetermined distance therefrom, and a liquid crystal material sealed between the two substrates. In the TFT array substrate, gate lines and data lines are formed in a matrix array, and TFTs are arranged at intersections of the gate lines and data lines. A voltage applied to the liquid crystal material is controlled by the TFTs to display images using electro optical effects of the liquid crystal material.

As the number of pixels increases owing to a high definition display of the active matrix type LCD, the number of the gate lines and data lines has become very large. Accordingly, the number of driving integrated circuits (driving ICs) also increases, raising costs. In addition, a pad pitch for bonding in the driving ICs and the array substrate decreases, hence bonding yield decreases owing to the difficulty of bonding between the driving ICs and the array substrate.

To solve these problems simultaneously, an LCD device and driving method thereof have been proposed in Korean Patent Publication No. 2005-0000105 (published Jan. 3, 2005), in which a voltage from one data line is supplied to two adjacent pixels in a time-divided fashion to reduce the number of data driving ICs and costs.

In the LCD device and driving method thereof proposed in Korean Patent Publication No. 2005-0000105, the polarity of data voltage is reversed on a frame-by-frame, line-by-line, or dot-by-dot basis. Gate pulses are supplied to associated gate lines such that they overlap with one another for a ½ horizontal period during each horizontal period.

FIG. 2 is a waveform diagram illustrating polarities of data voltages and gate pulses supplied to pixels shown in FIGS. 1A and 1B.

Firstly, data voltage is supplied such that its polarity is reversed for every horizontal line. Gate pulses are supplied to associated gate lines such that the gate pulse supplied to one gate line overlaps with that of the previous gate line for a ½ horizontal period. Here, the gate pulses supplied to the gate lines have the same pulse width.

Consequently, in every horizontal period, each pixel 16 (shown in FIGS. 1A and 1B) is precharged with data voltage during a first period, for which the gate pulse supplied to the associated gate line overlaps with that of the previous gate line, and is charged with data voltage during the remaining second period.

Hereinafter, this operation will be described in detail with reference to FIG. 2 and FIGS. 1A and 1B.

Firstly, during a period just before the first period of a first horizontal period, the odd pixels 16 connected to a first gate line GL1 are precharged with data voltage having a negative (−) polarity supplied from the data lines DL to the pixels 16 of the last horizontal line, respectively, by a gate pulse overlapped with a gate pulse supplied to an Nth gate line.

Next, during the first period of the first horizontal period, each odd pixel 16 connected to the first gate line GL1 and precharged with the negative-polarity data voltage is charged with data voltage having a positive (+) polarity for odd pixels provided from the associated data line DL, by the gate pulse provided to the first gate line GL1.

Also, during the first period of the first horizontal period, each even pixel 16 connected to a second gate line GL2 is precharged with data voltage having a positive (+) polarity for odd pixels provided from the associated data line DL, by the gate pulse provided to the second gate line GL2 to overlap with the gate pulse supplied to the first gate line.

Next, during a second period of the first horizontal period, each odd pixel 16 connected to the second gate line GL2 precharged with the positive-polarity data voltage for odd pixels is charged with data voltage having a positive (+) polarity for even pixels provided from each of the associated data lines DL, by the gate pulse provided to the second gate line GL2.

Also, during the second period of the first horizontal period, each odd pixel 16 connected to a third gate line GL3 is precharged with data voltage having a positive (+) polarity for even pixels provided from the associated data line DL, by the gate pulse provided to the third gate line GL3 to overlap with the gate pulse supplied to the second gate line.

Consequently, during the first horizontal period, the associated odd and even pixels 16 respectively connected to the left and the right of each data line DL are charged with the positive-polarity data voltage.

Next, during a first period of a second horizontal period, each odd pixel 16 connected to a third gate line GL3 precharged with the positive-polarity data voltage is charged with data voltage having a negative (−) polarity for odd pixels provided from the associated data line DL, by the gate pulse provided to the third gate line GL3.

Also, during the first period of the second horizontal period, each even pixel 16 connected to a fourth gate line GL4 is precharged with data voltage having a negative (−) polarity for odd pixels provided from the associated data line DL, by the gate pulse provided to the fourth gate line GL4 to overlap with the gate pulse supplied to the third gate line.

Next, during a second period of the second horizontal period, each even pixel 16 connected to the fourth gate line GL4 precharged with the negative-polarity data voltage for odd pixels is charged with data voltage having negative (−) polarity for odd pixels provided from the associated data line DL, by the gate pulse provided to the fourth gate line GL4.

Also, during the second period of the second horizontal period, each odd pixel 16 connected to a fifth gate line GL5 is precharged with data voltage having a negative (−) polarity for even pixels provided from the associated data line DL, by the gate pulse provided to the fifth gate line GL5 to overlap with the gate pulse supplied to the fourth gate line.

Consequently, during the second horizontal period, the associated odd and even pixels 16 respectively connected to the left and the right of each data line DL are charged with the negative-polarity data voltage.

During a third to Nth horizontal periods, in the same way as the first and the second horizontal periods, gate pulses having the same pulse width are supplied to the gate lines connected with the odd and even pixels 16 associated with each data line, respectively, and positive and negative polarity data voltages are supplied to each data line.

In sum, the driving method proposed in Korean Patent Publication No. 2005-0000105, drives the LCD device using a line inversion scheme.

However, in the LCD device and the driving method thereof proposed in Korean Patent Publication No. 2005-0000105, because gate pulses having the same pulse width and pulse height are sequentially supplied to the gate lines, there exists a problem in that vertical dimming occurs owing to a brightness difference between odd-column pixels Po connected to one side of each one of the data lines and odd gate lines GL1, GL3, . . . , GLn−1 and even-column pixels Pe connected to the other side of each one of the data lines and even gate lines GL2, GL4, . . . , GLn.

Specifically, while the polarity of the precharged data voltage is opposite to the polarity of the charged data voltage in the odd-column pixels Po, the polarity of the precharged data voltage is equal to the polarity of the charged data voltage in the even-column pixels Pe. Namely, the odd-column pixels Po are either charged with the positive-polarity data voltage after being precharged with the negative-polarity voltage or are charged with the negative-polarity data voltage after being precharged with the positive-polarity voltage. To the contrary, the even-column pixels Pe are either charged with the negative-polarity data voltage after being precharged with the negative-polarity voltage or charged with the positive-polarity data voltage after being precharged with the positive-polarity voltage. Thus, the data voltages for precharge respectively applied to the odd-column pixels Po and the even-column pixels Pe have different polarities.

Accordingly, in the LCD device and the driving method thereof proposed in Korean Patent Publication No. 2005-0000105, there is a problem in that picture quality is degraded owing to the vertical dimming caused by a difference between the data voltage charged at each of the odd-column pixels Po and the data voltage charged at each of the even-column pixels Pe.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1A:
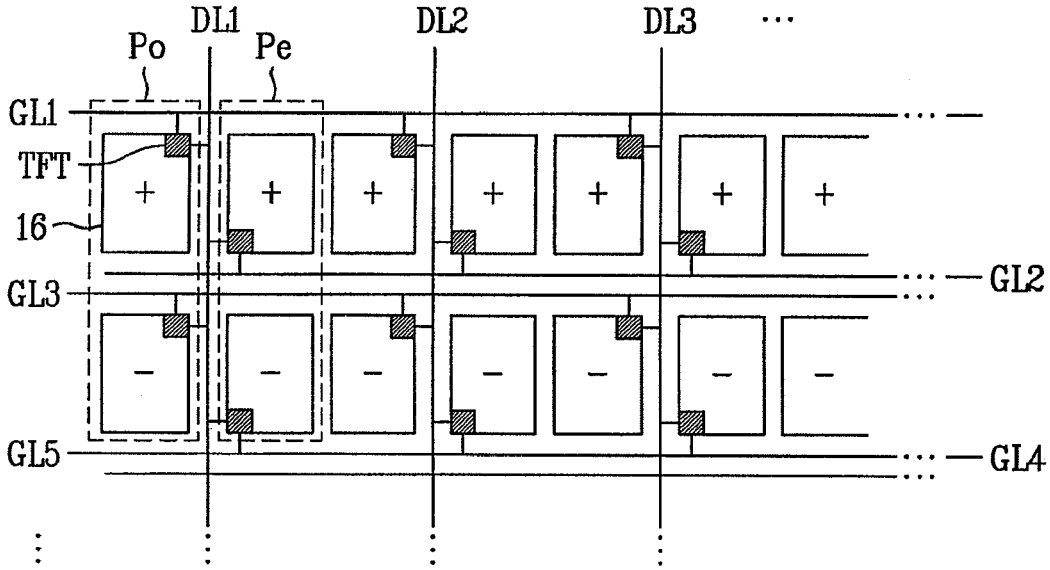
FIG. 1A Related Art
FIGS. 1A and 1B illustrate arrangements of pixels in conventional line inversion scheme.
Figure 1B:
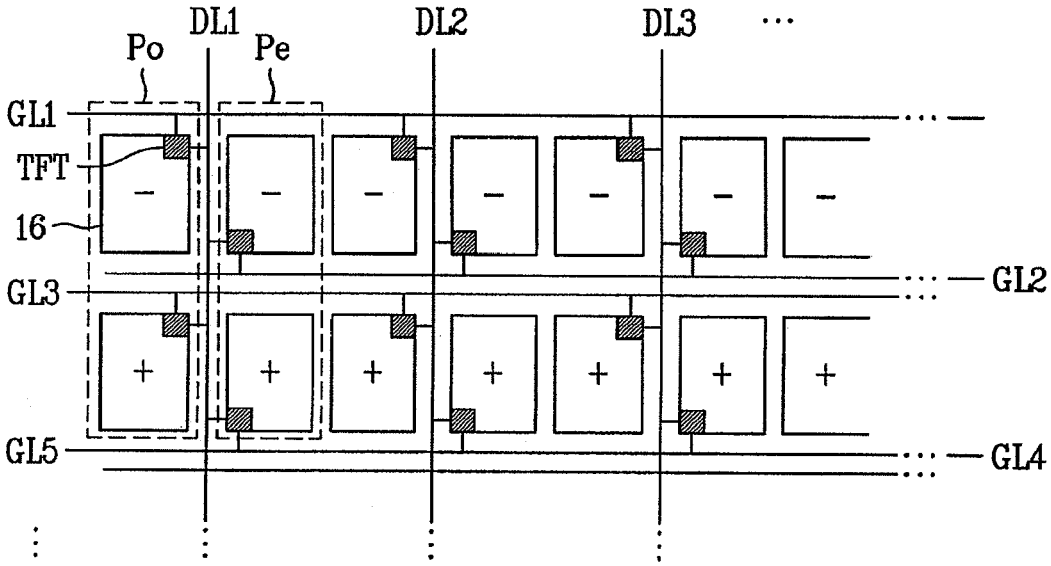
FIG. 1B Related Art
Figure 2:
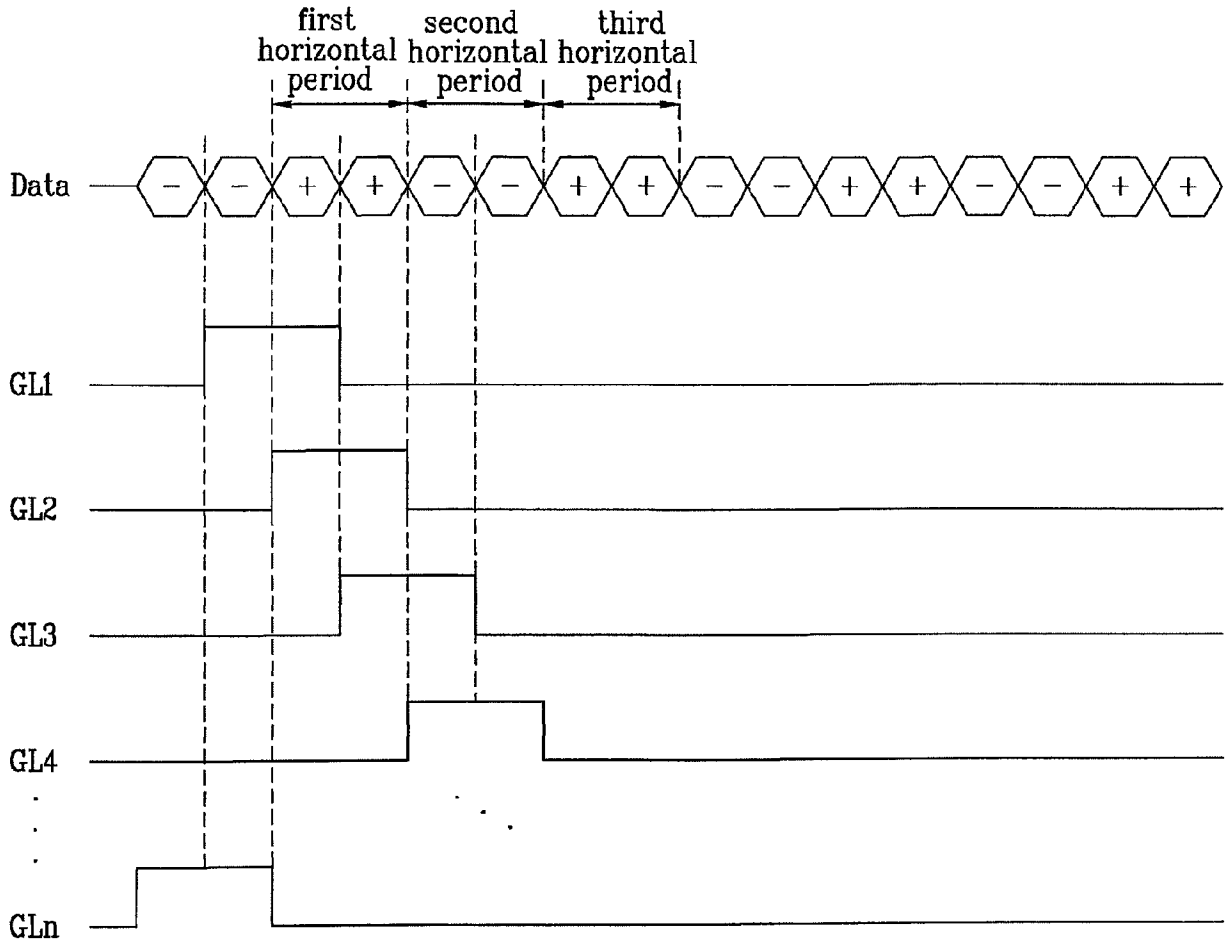
FIG. 2 Related Art
FIG. 2 is a waveform diagram illustrating polarities of data voltages and gate pulses supplied to the pixels of FIGS. 1A and 1B.
Figure 3:
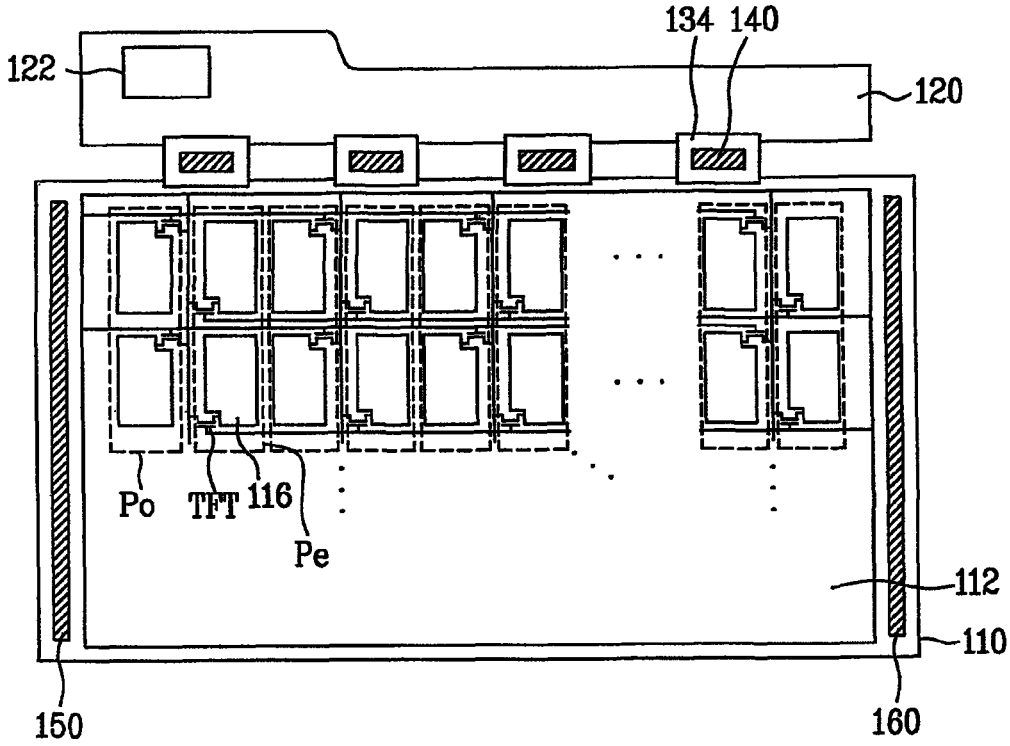
FIG. 3 illustrates an apparatus for driving a liquid crystal display device according to the first embodiment of the present invention.

FIG. 3 illustrates an apparatus for driving a liquid crystal display device according to the first embodiment of the present invention.

Referring to FIG. 3, the apparatus for driving a liquid crystal display device comprises a liquid crystal panel 110. The liquid crystal panel 110 comprises an image display 112 including a plurality of data lines DL and a plurality of gate lines GL. The image display 112 also includes odd-column pixels Po each of which is connected to a first side of one of the data lines DL and connected to one of the odd gate lines GL1, GL3, . . . , GLn−1, and even-column pixels Pe each of which is connected to a second side of one of the data lines and connected to one of the even gate lines GL2, GL4, . . . , GLn. The driving apparatus also comprises a gate driver for providing first and second gate pulses having different widths to the odd gate lines GL1, GL3, . . . , GL n−1 and the even gate lines GL2, GL4, . . . , GLn, respectively, and a plurality of data integrated circuits 140 for providing data voltages having a positive or negative polarity to the data lines DL, respectively. The driving apparatus further comprises a timing controller 122 for performing supply and control of data signals to provide the data voltages to the data lines DL, and for controlling the gate driver.

The apparatus for driving a liquid crystal display according to the first embodiment of the present invention further comprises a printed circuit board 120, on which a power circuit (not shown) is mounted together with the timing controller 122, and a plurality of tape carrier packages (hereinafter, referred to as "TCPs") 134, which are connected between the printed circuit board 120 and the liquid crystal panel 110. The data integrated circuits 140 are mounted in the TCPs 134, respectively.

The gate driver of the liquid crystal display driving apparatus includes a first gate driver circuit 150 for providing gate pulses having a first width to the odd gate lines GL1, GL3, . . . , GLn−1, and a second gate driver circuit 160 for providing gate pulses having a second width different from the first width to the even gate lines GL2, GL4, . . . , GLn.

The image display 112 displays an image by controlling light transmittance of the pixels according to gate pulses supplied to the gate lines GL and data voltages supplied to the column pixels Po and Pe.

Each of the TCPs 134 is electrically connected to the printed circuit board 120 and to the liquid crystal panel 110 using tape automated bonding (TAB). Input pads of each TCP 134 are electrically connected to the printed circuit board 120, and output pads are electrically connected to the liquid crystal panel 110.

The timing controller 122 adequately arranges source data provided from an external driving system for driving the liquid crystal panel 110 and supplies the arranged source data to the data integrated circuits 140 according to vertical and horizontal synchronous signals, and a data enable signal provided from the external driving system.

The timing controller 122 controls driving timing of the data integrated circuits 140 using the vertical and horizontal synchronous signals and the data enable signal provided from the driving system. To this end, the timing controller 122 generates data control signals including a source start pulse (SSP), source shift clock (SSC), a polarity control signal (POL), and a source output enable signal (SOE), and supplies the generated data control signals to the data integrated circuits 140. The timing controller 122 generates a polarity control signal such that the polarity pattern of an image supplied to the image display 112 can be reversed for every horizontal line, namely, can be line-inverted.

Using the vertical and horizontal synchronous signals and the data enable signal provided from the driving system, the timing controller 122 generates gate control signals including a gate start pulse (GSP) for controlling driving timing of the first and second gate driver circuits 150 and 160, a plurality of gate shift clocks (GSC), and a gate output enable (GOE) signal, and supplies the generated gate control signals to the first and second gate driver circuits 150 and 160.

The timing controller 122 generates a plurality of gate shift clocks (GSC) in accordance with the number of the gate shift clocks used to drive shift registers constituting the first and second gate driver circuits 150 and 160. In this description, it is assumed that each of the first and second gate driver circuits 150 and 160 uses two gate shift clocks to generate gate pulses.

Figure 4:
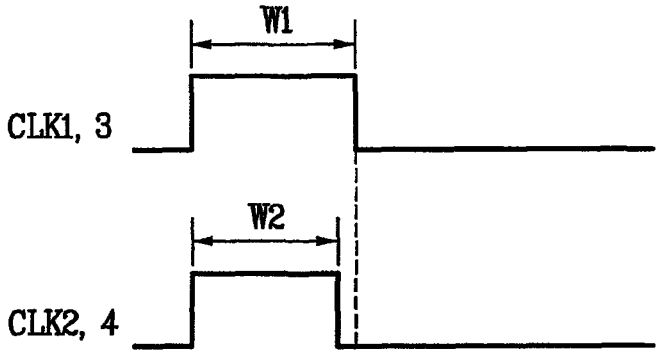
FIG. 4 is a waveform diagram illustrating a first to fourth gate shift clocks generated from a timing controller of FIG. 3.

Hence, using the vertical and horizontal synchronous signals and the data enable signal, the timing controller 122 generates first and third gate shift clocks CLK1 and CLK3 having a first width W1 and second and fourth gate shift clocks CLK2 and CLK4 having a second width W2, as shown in FIG. 4. The first width W1 is set to be wider than the second width W2. Preferably, the ratio of the first width W1 to the second width W2 is set to be at least about 4:3 and/or at most about 2:1. In one example, the ratio is about 10:7.

Especially, the timing controller 122 generates the first and third gate shift clocks CLK1 and CLK3 having the first width W1 and the second and fourth gate shift clocks CLK2 and CLK4 having the second width W2 by using a data enable signal and first and second masking signals different from each other. That is, the timing controller 122 generates a reference clock by dividing the data enable signal into two, and counting the divided data enable signal. Then, the timing controller 122 controls the falling time of the reference clock according to the generated reference clock and the first masking signal, thereby generating the first and third gate shift clocks CLK1 and CLK3 having the first width W1. Also, the timing controller 122 controls the falling time of the reference clock according to the reference clock and the second masking signal, thereby generating the second and fourth gate shift clocks CLK2 and CLK4 having the second width.

The timing controller 122 delays the phases of the first to fourth gate shift clocks CLK1 to CLK4 in sequence so as to overlap for a half horizontal period, and supplies the phase-delayed gate shift clocks CLK1 to CLK4 to the first and second gate driver circuits 150 and 160. The first and third gate shift clocks CLK1 and CLK3 having the first width W1 are supplied to the first gate driver circuit 150. The second and fourth gate shift clocks CLK2 and CLK4 having the second width W2 are supplied to the second gate driver circuit 160.

Each of the data integrated circuits 140 converts a data signal from the timing controller 122 to analog data voltage and supplies the analog data voltage to the associated data line DL of the liquid crystal panel 110 through the output pads of the associated TCP 134, according to data control signals inputted through the input pads of the TCP 134. Each of the data integrated circuits 140 generates data voltage having a positive (+) or negative (−) polarity according to the polarity control signal (POL), and supplies the data voltage to the associated data line DL according to a source output enable signal (SOE) from the timing controller 122.

The first gate driver circuit 150 is formed at one side of the liquid crystal panel 110 and electrically connected with the odd gate lines GL1, GL3, . . . , GLn−1 of the image display 112. The first gate driver circuit 150 is driven by the gate start pulse GSP from the timing controller 122, generates gate pulses having the first width W1 which are sequentially phase-delayed by one horizontal period according to the first and third gate shift clocks CLK1 and CLK3 from the timing controller 122, and sequentially supplies the gate pulses having the first width W1 to the odd gate lines GL1, GL3, . . . , GLn−1 according to the gate output enable signal GOE.

The second gate driver circuit 160 is formed at the other side of the liquid crystal panel 110 and electrically connected with the even gate lines GL2, GL4, . . . , GLn of the image display 112. The second gate driver circuit 160 is driven by the gate start pulse GSP from the timing controller 122, generates gate pulses having the second width W2 which are sequentially phase-delayed by one horizontal period according to the second and fourth gate shift clocks CLK2 and CLK4 from the timing controller 122, sequentially supplies the gate pulses having the second width W2 to the even gate lines GL2, GL4, . . . , GLn according to the gate output enable signal GOE.

Consequently, the first and second gate driver circuits 150 and 160 sequentially supply, to the gate lines GL of the image display 112, the gate pulses each overlapping with one another for the half horizontal period.

Figure 5:
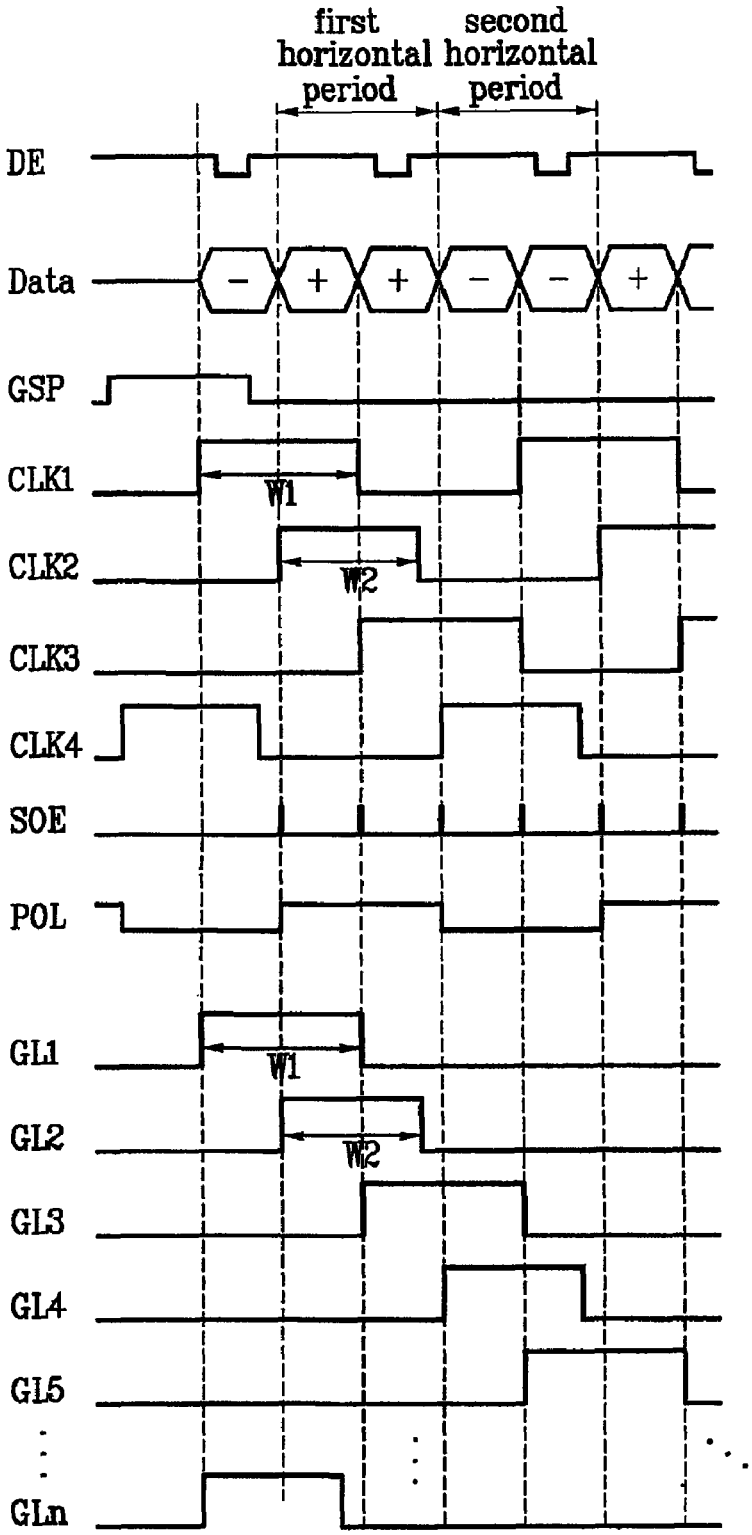
FIG. 5 is a waveform diagram illustrating a driving method for the liquid crystal display device according to the first embodiment of the present invention.

FIG. 5 is a waveform diagram illustrating a driving method for the liquid crystal display device according to an embodiment of the present invention.

Firstly, the polarity of the data voltage is reversed for every horizontal line (1 horizontal period) Gate pulses, overlapped with one another for the half horizontal period, having the first width W1 and the second width W2 are sequentially supplied to the odd gate lines GL1, GL3, . . . , GLn−1 and the even gate lines GL2, GL4, . . . , GLn, respectively.

In every horizontal period, each pixel 116 is precharged with data voltage during a first period, for which the gate pulse supplied to the associated gate line GL overlaps with that of the previous gate line GL, and is charged with data voltage during the remaining second period. The data voltage charge time in odd-column pixels Po by the gate pulses having the first width W1 is longer than the data voltage charge time in even-column pixels Pe by the gate pulses having the second width W2.

Hereinafter, the driving method for the liquid crystal display device according to the first embodiment of the present invention is explained with reference to FIGS. 3 and 5.

Firstly, during a period before a first horizontal period, it is assumed that each of the odd pixels 116 connected to a first gate line GL1 is precharged with a data voltage having a negative (−) polarity by a gate pulse having the first width W1 provided from the first gate driver circuit 150 so as to overlap with a gate pulse having the second width W2 provided to an nth gate line GLn.

Next, during the first horizontal period, the second gate driver circuit 160 supplies a gate pulse having the second width W2 to a second gate line GL2 such that the gate pulse is overlapped with the gate pulse having the first width W1 supplied by the first gate driver circuit 150 to the first gate line GL1.

Hence, during a first period of the first horizontal period, for which the gate pulse having the first width W1 supplied to the first gate line GL1 and the gate pulse having the second width W2 supplied to the second gate line GL2 overlap, each odd pixel 116 connected to the first gate line GL1 precharged with a data voltage having a negative (−) polarity is charged with data voltage having a positive (+) polarity for odd pixels from the associated data line DL by a gate pulse having the first width W1. In the same period, each even pixel 116 connected to the second gate line GL2 is precharged with a positive (+) polarity data voltage for odd pixels supplied from the associated data line DL by the gate pulse having the second width W2.

Next, the first gate driver circuit 150 supplies a gate pulse having the first width W1 to a third gate line GL3 such that the gate pulse is overlapped with the gate pulse having the second width W2 supplied by the second gate driver circuit 160 to the second gate line GL2. Hence, during a second period of the first horizontal period, for which the gate pulse having the second width W2 supplied to the second gate line GL2 and the gate pulse having the first width W1 supplied to the third gate line GL3 overlap, each even pixel 116 connected to the second gate line GL2 and precharged with a data voltage having a positive (+) polarity is charged with an even data voltage having a positive (+) polarity supplied from the associated data line DL by a gate pulse having the second width W2. Each odd pixel 116 connected to the third gate line GL3 is precharged with a positive (+) polarity data voltage for even pixels supplied from the associated data line DL by the gate pulse having the first width W1.

Consequently, during the first horizontal period, the associated odd and even pixels 116 respectively connected to the left and right of each data line DL, are charged with the positive-polarity data voltages. The time that the even pixel 116 precharged with the positive-polarity data voltage is charged with the positive-polarity data voltage is shorter than the time that the odd pixel 116 precharged with the negative-polarity data voltage by the gate pulse having the second width W2 charged with the positive-polarity data voltage.

Next, during the second horizontal period, the second gate driver circuit 160 supplies a gate pulse having the second width W2 to the fourth gate line GL4 such that the gate pulse is overlapped with the gate pulse having the first width W1 supplied by the first gate driver circuit 150 to the third gate line GL3.

Hence, during a first period of the second horizontal period, for which the gate pulse having the first width W1 supplied to the third gate line GL3 and the gate pulse having the second width W2 supplied to the fourth gate line GL4 overlap, each odd pixel 116 connected to the third gate line GL3 and precharged with a data voltage having a positive polarity is charged with an odd data voltage having a negative polarity supplied from the associated data line DL by a gate pulse having the first width W1. Each of the even pixels 116 connected to the fourth gate line GL4 is precharged with a negative polarity data voltage for odd pixels supplied from the associated data line DL by the gate pulse having the second width W2.

Next, the first gate driver circuit 150 supplies a gate pulse having the first width W1 to the fifth gate line GL5 such that the gate pulse is overlapped with the gate pulse having the second width W2 supplied by the second gate driver circuit 160 to the fourth gate line GL4. Hence, during a second period of the second horizontal period, for which the gate pulse having the second width W2 supplied to the fourth gate line GL4 and the gate pulse having the first width W1 supplied to the fifth gate line GL5 overlap, each of the even pixels 116 connected to the fourth gate line GL4 and precharged with a data voltage having a negative polarity is charged with an even data voltage having a negative polarity from the associated data line DL by a gate pulse having the second width W2. Each of the odd pixels 116 connected to the fifth gate line GL5 is precharged with a negative polarity data voltage for even pixels supplied from the associated data line DL by the gate pulse having the first width W1.

Consequently, during the second horizontal period, the associated odd and even pixels 116 respectively connected to the left and the right of each data line DL are charged with the negative-polarity data voltage. The time that the even pixel 116 precharged with the negative-polarity data voltage is charged with the negative-polarity data voltage is shorter than the time that the odd pixel 116 precharged with the positive-polarity data voltage by the gate pulse having the second width W2 is charged with the negative-polarity data voltage.

In the same way as the first and the second horizontal periods, during a third to Nth horizontal periods, the gate pulse having the first width W1 and the gate pulse having the second width W2 are supplied to the odd gate lines GL1, GL3, . . . , GLn−1 and the even gate lines GL2, GL4, GLn, respectively, such that the two gate pulses overlap for ½ of the horizontal period, and positive and negative polarity data voltages are supplied to the data lines.

In the apparatus and method for driving a liquid crystal display device according to the present invention, vertical dimming caused by a brightness difference between odd-column pixels Po and even-column pixels Pe can be minimized. One gate pulse having a first width is supplied to the odd-column pixels Po and another gate pulse having a second width is supplied to the even-column pixels Pe, making the charge time of the odd-column pixels Po different from that of the even-column pixels Pe.

Specifically, while the polarity of the precharged data voltages is opposite to the polarity of the charged data voltages in the odd-column pixels Po, the polarity of the precharged data voltages is equal to the polarity of the charged data voltages in the even-column pixels Pe. Namely, the odd-column pixels Po are either charged with the positive-polarity data voltages after being precharged with the negative-polarity voltage or are charged with the negative-polarity data voltages after being precharged with the positive-polarity voltage. To the contrary, the even-column pixels Pe are either charged with the negative-polarity data voltages after being precharged with the negative-polarity voltage or are charged with the positive-polarity data voltages after being precharged with the positive-polarity voltage.

According to the present invention, the odd-column pixels Po are charged with data voltage using a gate pulse having a first width W1, and the even-column pixels Pe are charged with data voltage using a gate pulse having a second width W2 narrower than the first width W1. Namely, in the odd-column pixels Po, the polarity of the precharged data voltages is opposite to the polarity of the charged data voltages, hence, effective data voltage charge time is increased using the first width W1. In the even-column pixels Pe, the polarity of the precharged data voltages is equal to the polarity of the charged data voltages, hence, effective data voltage charge time is reduced using the second width W2.

In the apparatus and method for driving a liquid crystal display device according to the first embodiment of the present invention, vertical dimming, which arises during line inversion driving of the image display 112, can be minimized by supplying gate pulses having different widths W1 and W2 to the odd-column pixels Po and the even-column pixels Pe, respectively.

Figure 6:
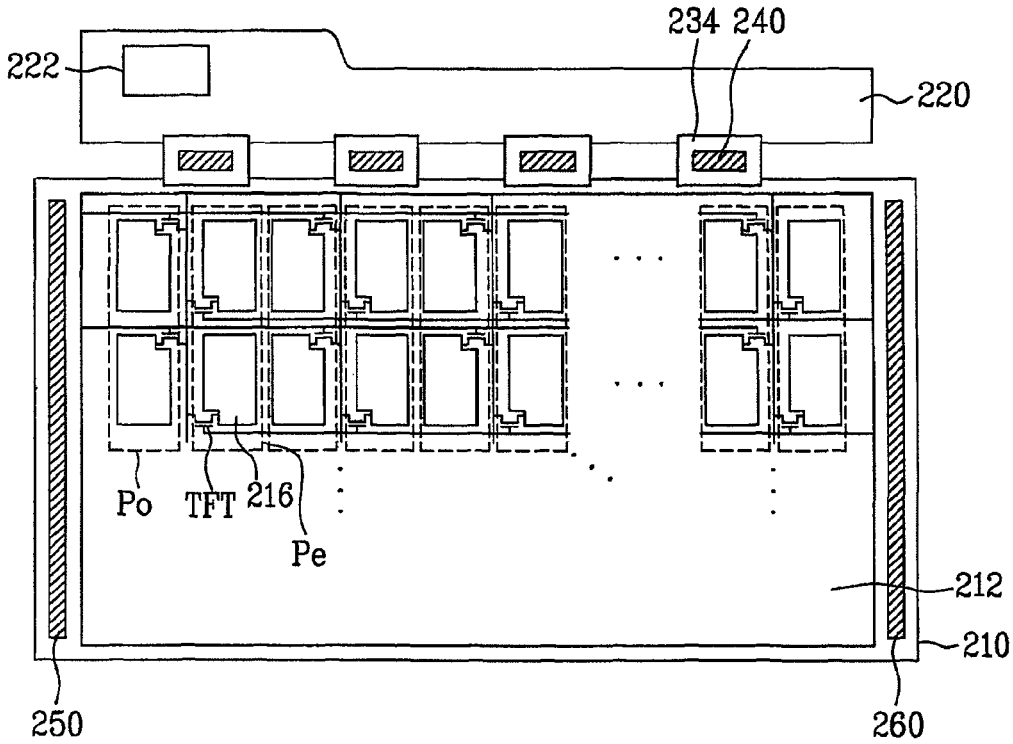
FIG. 6 is a waveform diagram illustrating a driving method for the liquid crystal display device according to the second embodiment of the present invention.

FIG. 6 illustrates an apparatus for driving a liquid crystal display device according to the second embodiment of the present invention.

Referring to FIG. 6, the apparatus for driving a liquid crystal display device comprises a liquid crystal panel 210. The liquid crystal panel 210 comprises an image display 212 including a plurality of data lines DL and 'n' gate lines GL. The image display 212 also includes odd-column pixels Po each of which is connected to a first side of one of the data lines DL and connected to one of the odd gate lines GL1, GL3, . . . , GLn−1, and even-column pixels Pe each of which is connected to a second side of one of the data lines and connected to one of the even gate lines GL2, GL4, . . . , GLn. The driving apparatus also comprises a gate driver for providing first and second gate pulses having different voltages to the odd gate lines GL1, GL3, . . . , GL n−1 and the even gate lines GL2, GL4, . . . , GLn, respectively, and a plurality of data integrated circuits 240 for providing data voltages having a positive or negative polarity to the data lines DL, respectively. The driving apparatus further comprises a timing controller 222 for performing supply and control of data signals to provide the data voltages to the data lines DL, and for controlling the gate driver.

The apparatus for driving a liquid crystal display according to the second embodiment of the present invention further comprises a printed circuit board 220, on which a power circuit (not shown) is mounted together with the timing controller 222, and a plurality of tape carrier packages (hereinafter, referred to as "TCPs") 234, which are connected between the printed circuit board 220 and the liquid crystal panel 210. The data integrated circuits 240 are mounted in the TCPs 234, respectively.

The gate driver of the liquid crystal display driving apparatus according to the second embodiment of the present invention includes a first gate driver circuit 250 for providing gate pulses having a first voltage to the odd gate lines GL1, GL3, . . . , GLn−1, and a second gate driver circuit 260 for providing gate pulses having a second voltage different from the first voltage to the even gate lines GL2, GL4, . . . , GLn.

The image display 212 displays an image by controlling light transmittance of the pixels according to gate pulses supplied to the gate lines GL and data voltages supplied to the column pixels Po and Pe.

Each of the TCPs 234 is electrically connected to the printed circuit board 220 and to the liquid crystal panel 110 using tape automated bonding (TAB). Input pads of each TCP 234 are electrically connected to the printed circuit board 220, and output pads are electrically connected to the liquid crystal panel 210.

The timing controller 222 arranges source data provided from an external driving system for driving the liquid crystal panel 210 and supplies the arranged source data to the data integrated circuits 240 according to vertical and horizontal synchronous signals, and a data enable signal provided from the external driving system.

The timing controller 222 controls driving timing of the data integrated circuits 240 using the vertical and horizontal synchronous signals and the data enable signal provided from the driving system. To this end, the timing controller 222 generates data control signals including a source start pulse (SSP), source shift clock (SSC), a polarity control signal (POL), and a source output enable signal (SOE), and supplies the generated data control signals to the data integrated circuits 240. The timing controller 222 generates a polarity control signal such that the polarity pattern of an image supplied to the image display 212 can be reversed for every horizontal line, namely, can be line-inverted.

Using the vertical and horizontal synchronous signals and the data enable signal provided from the driving system, the timing controller 222 generates gate control signals including a gate start pulse (GSP) for controlling driving timing of the first and second gate driver circuits 250 and 260, a plurality of gate shift clocks (GSC), and a gate output enable (GOE) signal, and supplies the generated gate control signals to the first and second gate driver circuits 250 and 260.

The timing controller 222 generates a plurality of gate shift clocks (GSC) in accordance with the number of the gate shift clocks used to drive shift registers constituting the first and second gate driver circuits 250 and 260. In this description, it is assumed that each of the first and second gate driver circuits 250 and 260 uses two gate shift clocks to generate gate pulses.

Figure 7:
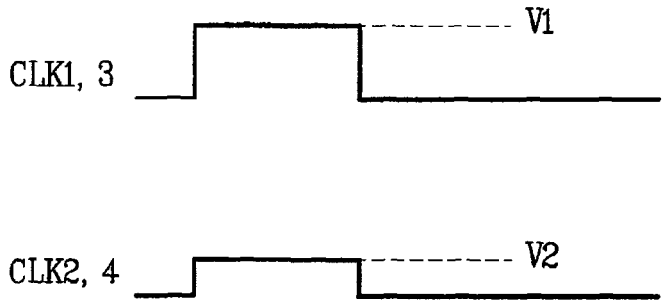
FIG. 7 is a waveform diagram illustrating a first to fourth gate shift clocks generated from a timing controller of FIG. 6.

Hence, using the vertical and horizontal synchronous signals and the data enable signal, the timing controller 222 generates first and third gate shift clocks CLK1 and CLK3 having a first voltage V1 and second and fourth gate shift clocks CLK2 and CLK4 having a second voltage V2, as shown in FIG. 7. The first voltage V1 is set to be higher than the second voltage V2.

The timing controller 222 delays the phases of the first to fourth gate shift clocks CLK1 to CLK4 having the first and second voltages V1 and V2 in sequence so as to overlap for a half horizontal period, and supplies the phase-delayed gate shift clocks CLK1 to CLK4 to the first and second gate driver circuits 250 and 260. The first and third gate shift clocks CLK1 and CLK3 having the first voltage V1 are supplied to the first gate driver circuit 250. The second and fourth gate shift clocks CLK2 and CLK4 having the second voltage V2 are supplied to the second gate driver circuit 260.

Each of the data integrated circuits 240 converts a data signal from the timing controller 222 to analog data voltage and supplies the analog data voltage to the associated data line DL of the liquid crystal panel 110 through the output pads of the associated TCP 234, according to data control signals inputted through the input pads of the TCP 234. Each of the data integrated circuits 240 generates data voltage having a positive (+) or negative (−) polarity according to the polarity control signal (POL), and supplies the data voltage to the associated data line DL according to source output enable signal (SOE) from the timing controller 222.

Figure 8:
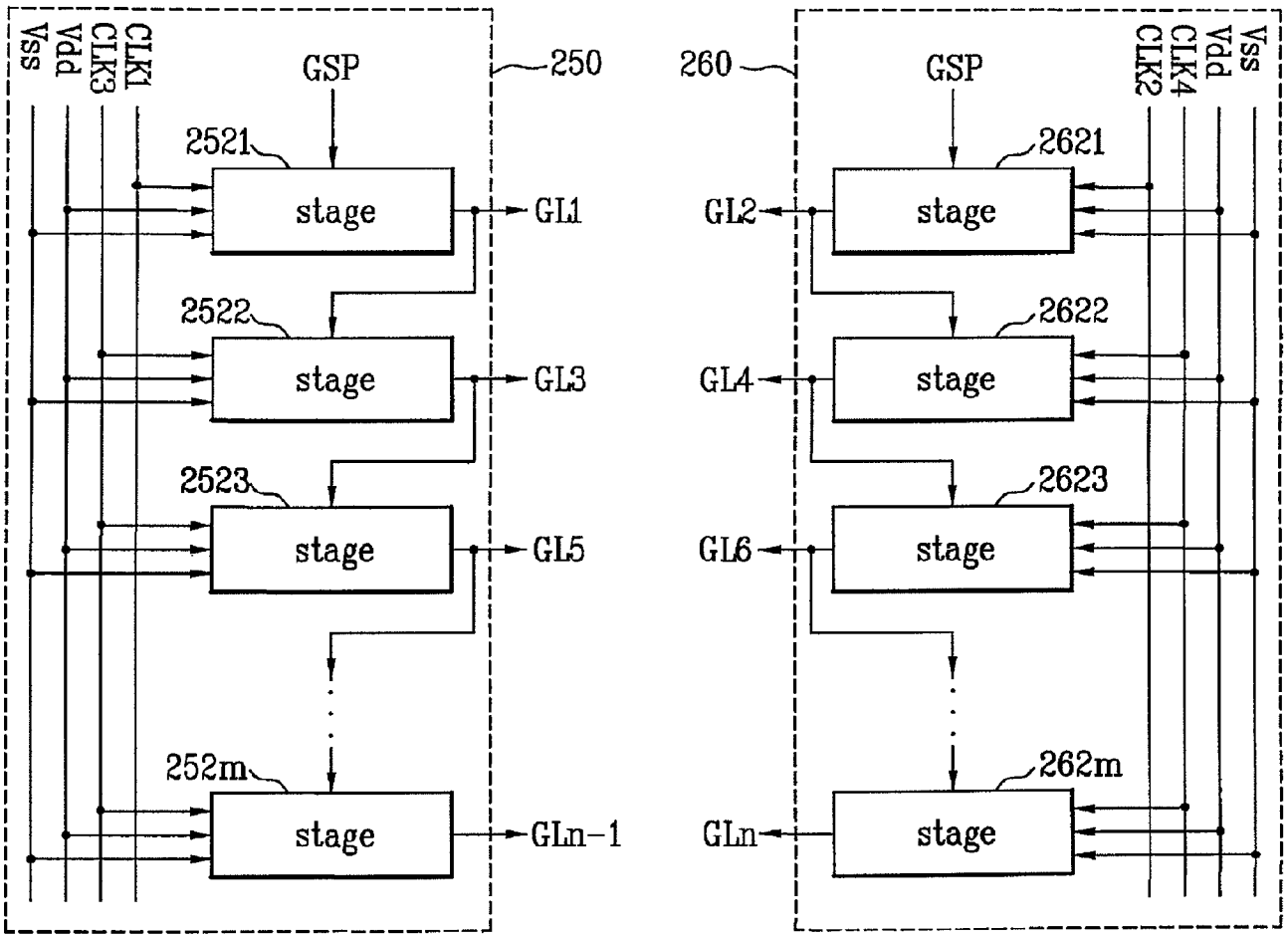
FIG. 8 illustrates a gate driver of FIG. 7.

As shown in FIG. 8, the first gate driver circuit 250 is provided with first and third gate shift clock CLK1 and CLK3 input lines, driving voltage Vdd and base voltage Vss input lines, a gate start pulse GSP input line, and 'm' stages (m, positive number of n/2) connected with the respective input lines for supplying the gate pulse of the first voltage V1 to the odd gate lines (GL1, GL3, . . . , GLn−1). The first gate driver circuit 250 is directly formed on the liquid crystal panel 210.

As shown in FIG. 7, the first and third gate shift clocks CLK1 and CLK3 having the first voltage V1 are sequentially phase-delayed by one horizontal period from the timing controller 222, and are sequentially supplied to the first and third gate shift clock CLK1 and CLK3 input lines.

Except the first stage 2521, each stage 2521 to 252*m* supplies the clock signal CLK1 and CLK3 of the first voltage V1 provided from one of the first and third gate shift clock input lines to the corresponding odd gate line GL1, GL3, . . . , GLn−1 according to the output signal of the previous stage 2522 to 252*m*. The first stage 2521 supplies the first gate shift clock CLK1 of the first voltage V1 provided from the input line of the first gate shift clock CLK1 to the first gate line GL1 according to the gate start pulse GSP from the timing controller 222.

The first gate drive circuit 250 is driven by the gate start pulse GSP from the timing controller 222, generates the gate pulses having the first voltage V1 which are sequentially phase-delayed by one horizontal period according to the first and third gate shift clocks CLK1 and CLK3 from the timing controller 222, sequentially supplies the gate pulses having the first voltage V1 to the odd gate lines GL1, GL3, . . . , GLn−1 according to the gate output enable signal GOE.

The second gate driver circuit 260 is provided with second and fourth gate shift clock CLK2 and CLK4 input lines, driving voltage Vdd and base voltage Vss input lines, a gate start pulse GSP input line, and 'm' stages (m, positive number of n/2) connected with the respective input lines for supplying the gate pulse of the second voltage V2 to the even gate lines (GL2, GL4, . . . , GLn). The second gate driver circuit 260 is directly formed on the liquid crystal panel 210.

As shown in FIG. 7, the second and fourth gate shift clocks CLK2 and CLK4 having the second voltage V2 are sequentially phase-delayed by one horizontal period from the timing controller 222, and are sequentially supplied to one end of the second and fourth gate shift clock CLK2 and CLK4 input lines.

Except the first stage 2621, each stage 2621 to 262*m* supplies the clock signal CLK2 and CLK4 of the second voltage V2 provided from one of the second and fourth gate shift clock input lines to the corresponding even gate line GL2, GL4, . . . , GLn according to the output signal of the previous stage 2622 to 262*m*. The first stage 2621 supplies the second gate shift clock CLK2 of the second voltage V2 provided from the input line of the second gate shift clock CLK2 to the second gate line GL2 according to the gate start pulse GSP from the timing controller 222.

The second gate drive circuit 260 is driven by the gate start pulse GSP from the timing controller 222, generates the gate pulses having the second voltage V2 which are sequentially phase-delayed by one horizontal period according to the second and fourth gate shift clocks CLK2 and CLK4 from the timing controller 222, sequentially supplies the gate pulses having the second voltage V2 to the even gate lines GL2, GL4, . . . , GLn according to the gate output enable signal GOE.

Consequently, the first and second gate driver circuits 250 and 260 sequentially supply, to the gate lines GL of the image display 212, the gate pulses each overlapping with one another for the half horizontal period.

Figure 9:
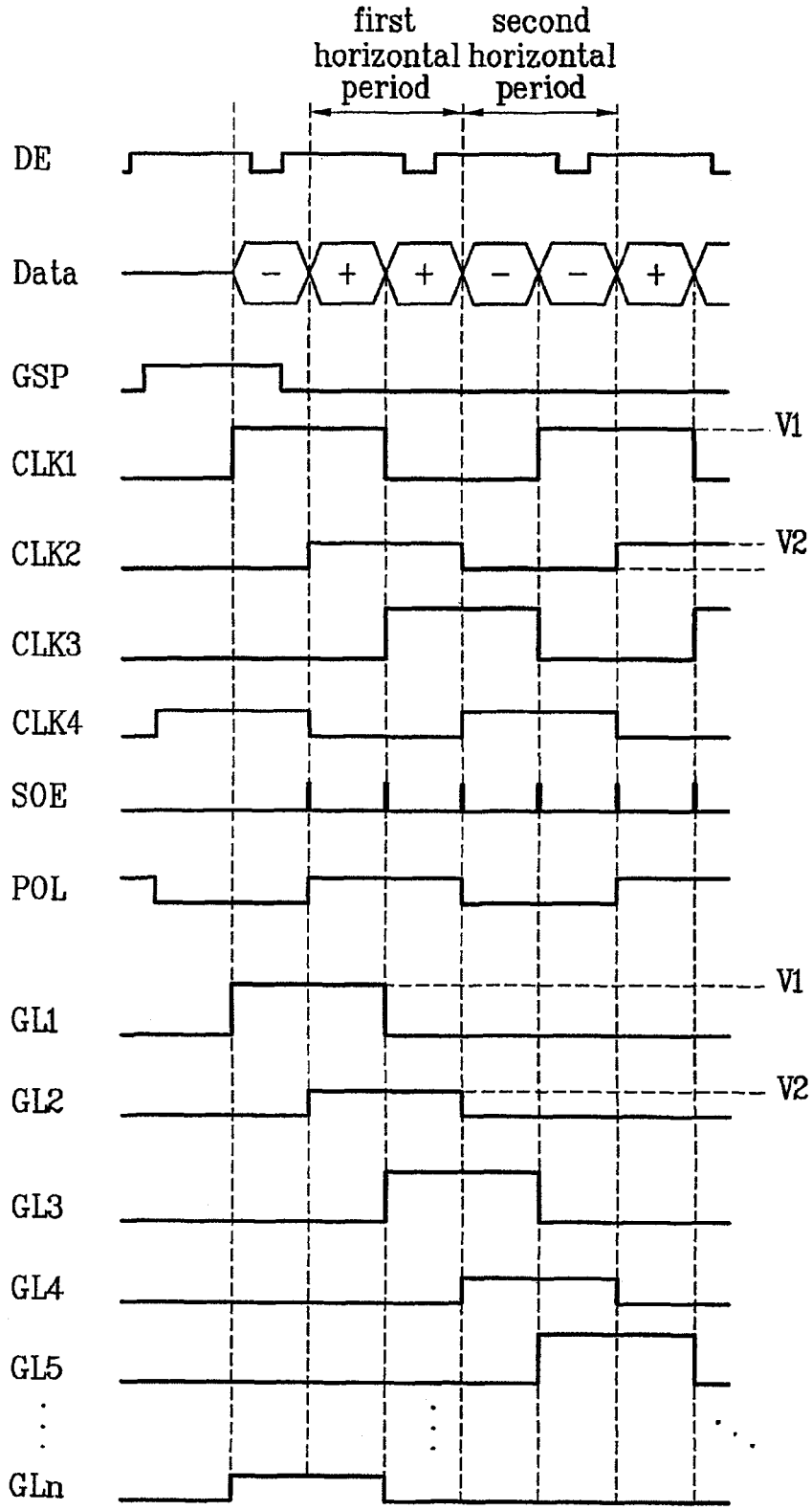
FIG. 9 is a waveform diagram illustrating a driving method for the liquid crystal display device according to the second embodiment of the present invention.

FIG. 9 is a waveform diagram illustrating a driving method for the liquid crystal display device according to the second embodiment of the present invention.

Firstly, the polarity of the data voltage is reversed for every horizontal line (1 horizontal period). Gate pulses, overlapped with one another for the half horizontal period, having the first voltage V1 and the second voltage V2 are sequentially supplied to the odd gate lines GL1, GL3, . . . , GLn−1 and the even gate lines GL2, GL4, . . . , GLn, respectively.

In every horizontal period, each pixel 216 is precharged with data voltage during a first period, for which the gate pulse supplied to the associated gate line GL overlaps with that of the previous gate line GL, and is charged with data voltage during the remaining second period. The data voltage charge time in odd-column pixels Po by the gate pulses having the first voltage V1 is substantially equal to that of the data voltage charge time in even-column pixels Pe by the gate pulses having the second voltage V2.

Hereinafter, the driving method for the liquid crystal display device according to the second embodiment of the present invention is explained with reference to FIG. 6.

Firstly, during a period before a first horizontal period, it is assumed that each of the odd pixels 216 connected to a first gate line GL1 is precharged with a data voltage having a negative (−) polarity by a gate pulse having the first voltage V1 provided from the first gate driver circuit 250 so as to overlap with a gate pulse having the second voltage V2 provided to an nth gate line GLn.

Next, during the first horizontal period, the second gate driver circuit 260 supplies a gate pulse having the second voltage V2 to a second gate line GL2 such that the gate pulse is overlapped with the gate pulse having the first voltage V1 supplied by the first gate driver circuit 250 to the first gate line GL1.

Hence, during a first period of the first horizontal period, for which the gate pulse having the first voltage V1 supplied to the first gate line GL1 and the gate pulse having the second voltage V2 supplied to the second gate line GL2 overlap, each odd pixel 216 connected to the first gate line GL1 precharged with a data voltage having a negative (−) polarity is charged with data voltage having a positive (+) polarity for odd pixels from the associated data line DL by a gate pulse having the first voltage V1. In the same period, each even pixel 216 connected to the second gate line GL2 is precharged with a positive (+) polarity data voltage for odd pixels supplied from the associated data line DL by the gate pulse having the second voltage V2.

Next, the first gate driver circuit 250 supplies a gate pulse having the first voltage V1 to a third gate line GL3 such that the gate pulse is overlapped with the gate pulse having the second voltage V2 supplied by the second gate driver circuit 260 to the second gate line GL2. Hence, during a second period of the first horizontal period, for which the gate pulse having the second voltage V2 supplied to the second gate line GL2 and the gate pulse having the first voltage V1 supplied to the third gate line GL3 overlap, each even pixel 216 connected to the second gate line GL2 and precharged with a data voltage having a positive (+) polarity is charged with an even data voltage having a positive (+) polarity supplied from the associated data line DL by a gate pulse having the second voltage V2. Each odd pixel 216 connected to the third gate line GL3 is precharged with a positive (+) polarity data voltage for even pixels supplied from the associated data line DL by the gate pulse having the first voltage V1.

Consequently, during the first horizontal period, the associated odd and even pixels 216 respectively connected to the left and right of each data line DL, are charged with the positive-polarity data voltages. The time that the even pixel 216 precharged with the positive-polarity data voltage is charged with the positive-polarity data voltage is substantially equal to the time that the odd pixel 216 precharged with the negative-polarity data voltage by the gate pulse having the second voltage V2 is charged with the positive-polarity data voltage.

Next, during the second horizontal period, the second gate driver circuit 260 supplies a gate pulse having the second voltage V2 to the fourth gate line GL4 such that the gate pulse is overlapped with the gate pulse having the first voltage V1 supplied by the first gate driver circuit 250 to the third gate line GL3.

Hence, during a first period of the second horizontal period, for which the gate pulse having the first voltage V1 supplied to the third gate line GL3 and the gate pulse having the second voltage V2 supplied to the fourth gate line GL4 overlap, each odd pixel 216 connected to the third gate line GL3 and precharged with a data voltage having a positive polarity is charged with an odd data voltage having a negative polarity supplied from the associated data line DL by a gate pulse having the first voltage V1. Each of the even pixels 216 connected to the fourth gate line GL4 is precharged with a negative polarity data voltage for odd pixels supplied from the associated data line DL by the gate pulse having the second voltage V2.

Next, the first gate driver circuit 250 supplies a gate pulse having the first voltage V1 to the fifth gate line GL5 such that the gate pulse is overlapped with the gate pulse having the second voltage V2 supplied by the second gate driver circuit 260 to the fourth gate line GL4. Hence, during a second period of the second horizontal period, for which the gate pulse having the second voltage V2 supplied to the fourth gate line GL4 and the gate pulse having the first voltage V1 supplied to the fifth gate line GL5 overlap, each of the even pixels 216 connected to the fourth gate line GL4 and precharged with a data voltage having a negative polarity is charged with an even data voltage having a negative polarity from the associated data line DL by a gate pulse having the second voltage V2. Each of the odd pixels 216 connected to the fifth gate line GL5 is precharged with a negative polarity data voltage for even pixels supplied from the associated data line DL by the gate pulse having the first voltage V1.

Consequently, during the second horizontal period, the associated odd and even pixels 216 respectively connected to the left and the right of each data line DL are charged with the negative-polarity data voltage. The time that the even pixel 216 precharged with the negative-polarity data voltage is charged with the negative-polarity data voltage is substantially equal to the time that the odd pixel 116 precharged with the positive-polarity data voltage by the gate pulse having the second voltage V2 is charged with the negative-polarity data voltage. Thus, the even pixel 216 is both charged and precharged by the gate pulse having the second voltage V2 while the odd pixel 216 is both charged and precharged by the gate pulse having the first voltage V1.

In the same way as the first and the second horizontal periods, during a third to Nth horizontal periods, the gate pulse having the first voltage V1 and the gate pulse having the second voltage V2 are supplied to the odd gate lines GL1, GL3, . . . , GLn−1 and the even gate lines GL2, GL4, . . . , GLn, respectively, such that the two gate pulses overlap for ½ of the horizontal period, and positive and negative polarity data voltages are supplied to the data lines.

In the apparatus and method for driving a liquid crystal display device according to the present invention, vertical dimming caused by a brightness difference between odd-column pixels Po and even-column pixels Pe can be minimized. One gate pulse having a first voltage is supplied to the odd-column pixels Po and another gate pulse having a second voltage is supplied to the even-column pixels Pe, thus substantially equalizing the amount of charge in the odd-column pixels Po and in the even-column pixels Pe.

Specifically, while the polarity of the precharged data voltages is opposite to the polarity of the charged data voltages in the odd-column pixels Po, the polarity of the precharged data voltages is equal to the polarity of the charged data voltages in the even-column pixels Pe. Namely, the odd-column pixels Po are either charged with the positive-polarity data voltages after being precharged with the negative-polarity voltages or are charged with the negative-polarity data voltages after being precharged with the positive-polarity voltages. The even-column pixels Pe, on the other hand, are either charged with the negative-polarity data voltages after being precharged with the negative-polarity voltages or are charged with the positive-polarity data voltages after being precharged with the positive-polarity voltages.

According to the present invention, the odd-column pixels Po are charged with data voltage using a gate pulse having a first voltage V1, and the even-column pixels Pe are charged with data voltage using a gate pulse having a second voltage V2 smaller than the first voltage V1.

In the apparatus and method for driving a liquid crystal display device according to the second embodiment of the present invention, vertical dimming, which arises during line inversion driving of the image display 212, can be minimized by supplying gate pulses having different voltages V1 and V2 to the odd-column pixels Po and the even-column pixels Pe, respectively.

Figure 10:
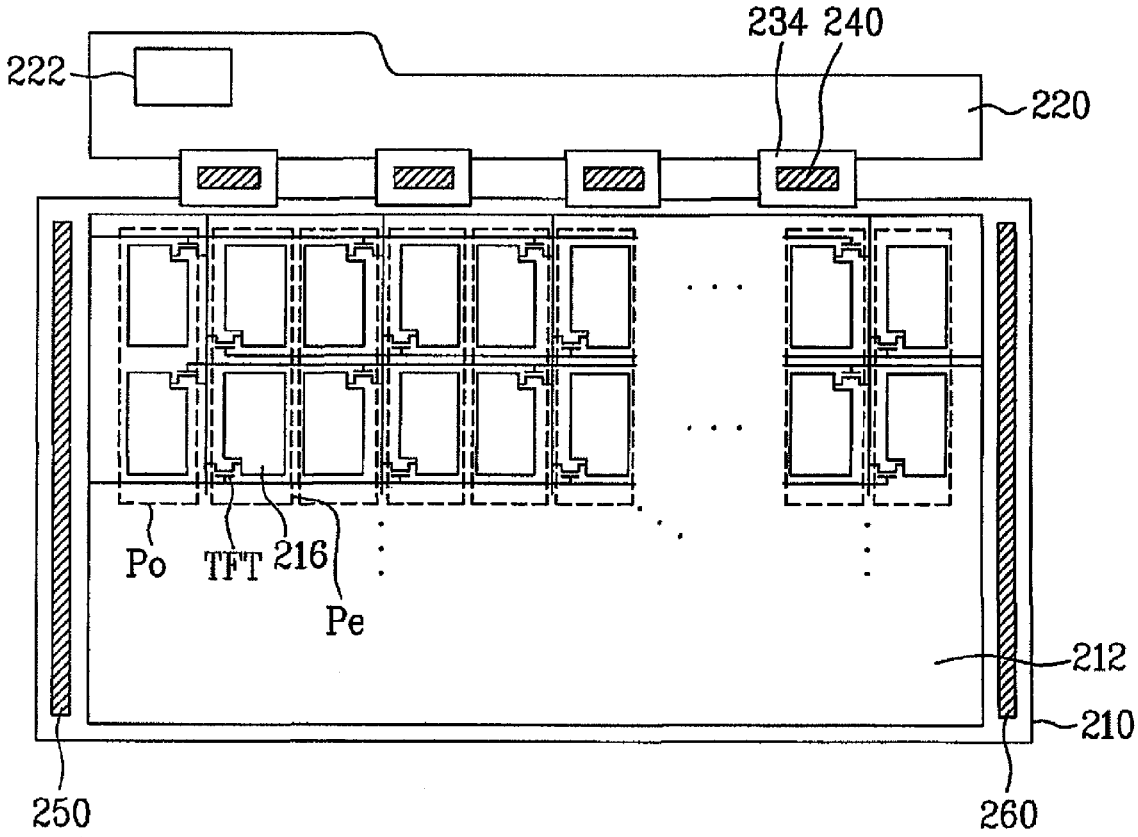
FIG. 10 illustrates an apparatus for driving a liquid crystal display device according to the third embodiment of the present invention.
Figure 11:
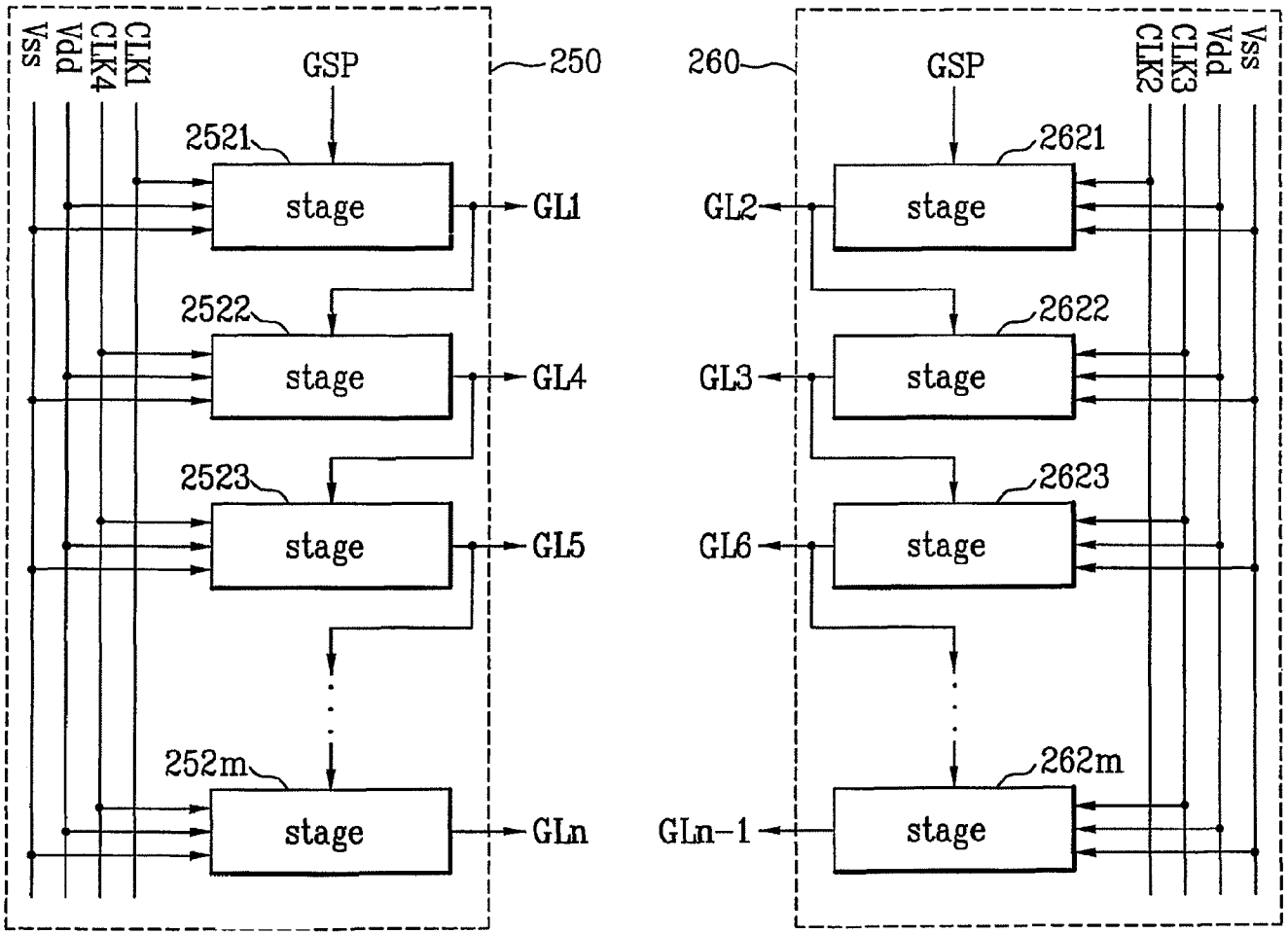
FIG. 11 illustrates a gate driver of FIG. 10.

FIG. 10 illustrates an apparatus for driving a liquid crystal display device according to the third embodiment of the present invention. FIG. 11 illustrates first and second gate driver circuits of FIG. 10.

Referring to FIG. 10 and FIG. 11, the apparatus for driving the liquid crystal display device comprises a liquid crystal panel 210. The liquid crystal panel 210 comprises an image display 212 including 'm' data lines DL and 'n' gate lines GL. The image display 212 also includes odd-column pixels Po each of which is connected to a first side of one of the data lines DL and connected to one of the odd gate lines GL1, GL3, . . . , GLn−1, and even-column pixels Pe each of which is connected to a second side of one of the data lines and connected to one of the even gate lines GL2, GL4, . . . , GLn. The driving apparatus also comprises a gate driver for providing gate pulses of first and second voltages having different voltage values to the odd-column pixels Po and the even-column pixels Pe, and a plurality of data integrated circuits 240 for providing data voltages having a positive or negative polarity to the data lines DL, respectively. The driving apparatus further comprises a timing controller 222 for performing supply and control of data signals to provide the data voltages to the data lines DL, and for controlling the gate driver.

Except the structure of the gate driver, the apparatus for driving the liquid crystal display device according to the third embodiment of the present invention is same in structure as the apparatus for driving the liquid crystal display device according to the second embodiment of the present invention. Thus, the gate driver in the apparatus for driving the liquid crystal display device according to the third embodiment of the present invention will be mainly explained as follows.

In the apparatus for driving the liquid crystal display device according to the third embodiment of the present invention, the gate driver is provided with a first gate driver circuit 250 and a second gate driver circuit 260. The first gate driver circuit 250 provides the gate pulse of the first voltage V1 to the '4i+1' ('i' corresponds to the positive number of 0 to 4/n) gate line (GL1, GL5 . . . ), and provides the gate pulse of the second voltage V2 to the '4i+4' gate line (GL4, GL8 . . . ). Also, the second gate driver circuit 260 provides the gate pulse of the first voltage V1 to the '4i+2' gate line (GL2, GL6 . . . ), and provides the gate pulse of the second voltage V2 to the '4i+3' gate line (GL3, GL7 . . . ).

The first gate driver circuit 250 is directly formed at one side of the liquid crystal panel 210, and is electrically connected with the '4i+1' and '4i+4' gate lines (GL1, GL4, GL5, GL8). The first gate driver circuit 250 is driven by the gate start pulse GSP from the timing controller 222, generates the gate pulses having the first and second voltages which are sequentially phase-delayed by one horizontal period according to the first and fourth gate shift clocks CLK1 and CLK4 from the timing controller 222, and sequentially supplies the gate pulses having the first and second voltages to the '4i+1' and '4i+4' gate lines (GL1, GL4, GL5, GL8) according to the gate output enable signal GOE.

The second gate driver circuit 260 is directly formed at the other side of the liquid crystal panel 110, and is electrically connected with the '4i+2' and '4i+3' gate lines (GL2, GL3, GL6, GL7). The second gate driver circuit 260 is driven by the gate start pulse GSP from the timing controller 222, generates the gate pulses having the first and second voltages which are sequentially phase-delayed by one horizontal period according to the second and third gate shift clocks CLK2 and CLK3 from the timing controller 222, and sequentially supplies the gate pulses having the first and second voltages to the '4i+2' and '4i+3' gate lines (GL2, GL3, GL6, GL7) according to the gate output enable signal GOE.

In the apparatus and method for driving the liquid crystal display device according to the third embodiment of the present invention, vertical dimming, which are generated by the difference of luminance between the odd-column pixels Po and the even-column pixels Pe, can be minimized by supplying the gate pulses having the different voltages to the odd-column pixels Po and the even-column pixels Pe, respectively.

Figure 12:
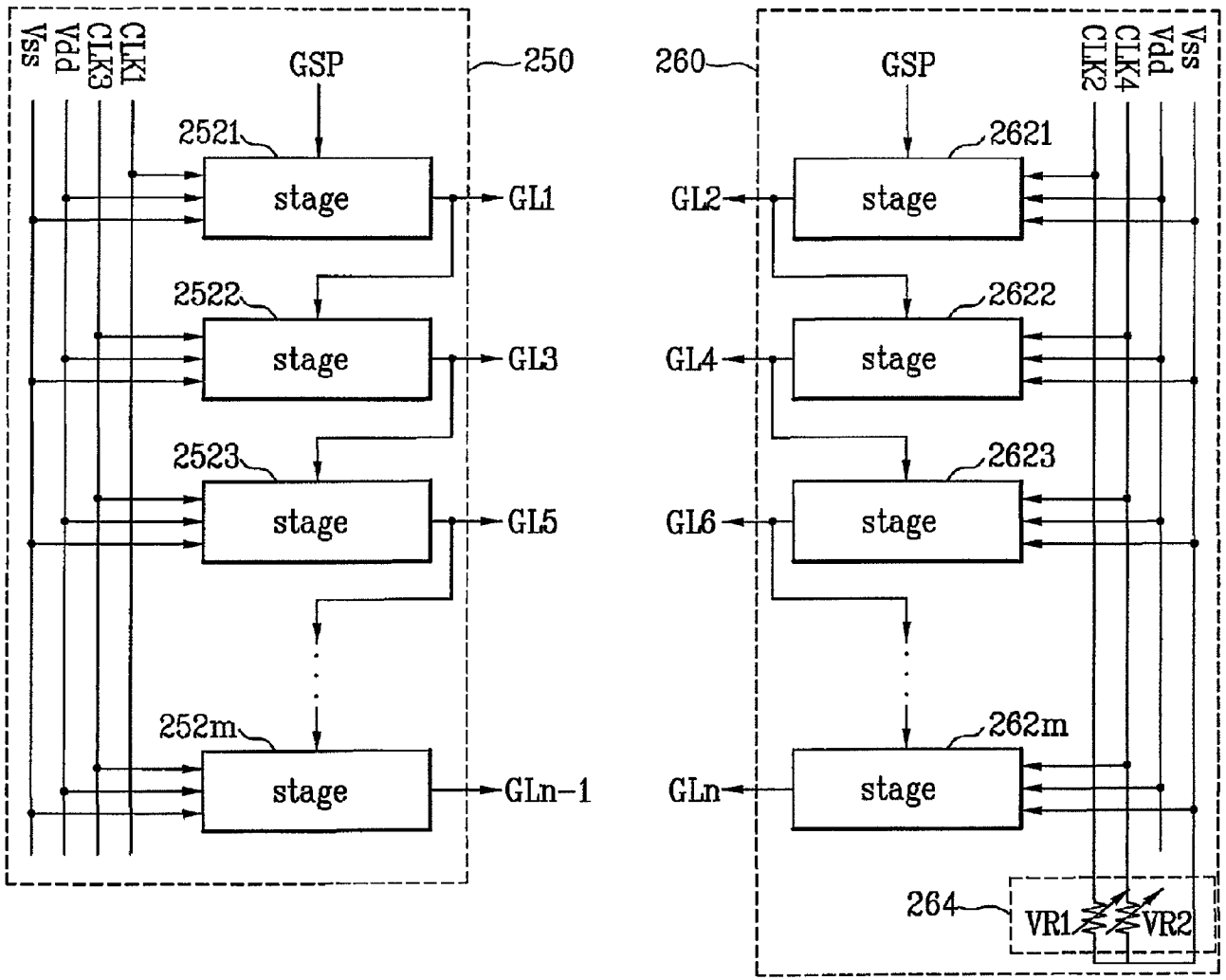
FIG. 12 illustrates a gate driver in an apparatus for driving a liquid crystal display device according to the fourth embodiment of the present invention.

FIG. 12 illustrates first and second gate driver circuits 250 and 260 in an apparatus for driving a liquid crystal display device according to the fourth embodiment of the present invention.

On explaining FIG. 12 in connection with FIG. 6, the first gate driver circuit 250 includes first and third gate shift clock CLK1 and CLK3 input lines, driving voltage Vdd and base voltage Vss input lines, a gate start pulse GSP input line, and 'm' stages (m, positive number of n/2) connected with the respective input lines for supplying the gate pulse of the first voltage V1 to the odd gate lines (GL1, GL3, . . . , GLn−1). The first gate driver circuit 250 is directly formed on the liquid crystal panel 210.

The first and third gate shift clocks CLK1 and CLK3 having the first voltage V1 are sequentially phase-delayed by one horizontal period from the timing controller 222, and are sequentially supplied to the first and third gate shift clock CLK1 and CLK3 input lines.

Except the first stage 2521, each stage 2521 to 252*m* supplies the clock signal CLK1 and CLK3 of the first voltage V1 provided from any one of the first and third gate shift clock input lines to the corresponding odd gate line GL1, GL3, . . . , GLn−1 according to the output signal of the previous stage 2522 to 252*m*. At this time, the first stage 2521 supplies the first gate shift clock CLK1 of the first voltage V1 provided from the input line of the first gate shift clock CLK1 to the first gate line GL1 according to the gate start pulse GSP from the timing controller 222.

The first gate driver circuit 250 sequentially supplies the gate pulses having the first voltage to the odd gate lines (GL1, GL3, . . . , GLn−1), wherein the gate pulses having the first voltage are sequentially phase-delayed by one horizontal period according to the first and third gate shift clocks CLK1 and CLK3.

The second gate driver circuit 260 is provided with second and fourth gate shift clock CLK2 and CLK4 input lines, driving voltage Vdd and base voltage Vss input lines, a gate start pulse GSP input line, and a voltage converter 264 connected between the second and fourth gate shift clock input lines and the base voltage input line to convert the second and fourth gate shift clocks CLK2 and CLK4 of the first voltage V1 to the second voltage V2, and 'm' stages (m, positive number of n/2) connected with the respective input lines for supplying the gate pulse of the second voltage V2 to the even gate lines (GL2, GL4, . . . , GLn). The second gate driver circuit 260 is directly formed on the liquid crystal panel 210.

The second and fourth gate shift clocks CLK2 and CLK4 having the second voltage V2 are sequentially phase-delayed by one horizontal period from the timing controller 222, and are sequentially supplied to one end of the second and fourth gate shift clock CLK2 and CLK4 input lines.

The voltage converter 264 is comprised of a first variable resistor VR1 and a second variable resistor VR2. The first variable resistor VR1 is connected between the other end of the second gate shift clock input line and the base voltage input line. Also, the second variable resistor VR2 is connected between the other end of the fourth gate shift clock input line and the base voltage input line. The first variable resistor VR1 converts the second gate shift clock CLK2 having the first voltage inputted to the second gate shift clock input line to the second voltage V2, which is lower than the first voltage V1. Also, the second variable resistor VR2 converts the fourth gate shift clock CLK4 having the first voltage inputted to the fourth gate shift clock input line to the second voltage V2.

Except the first stage 2621, each stage 2621 to 262*m* supplies the clock signal CLK2 and CLK4 of the second voltage V2 provided from one of the second and fourth gate shift clock input lines to the corresponding even gate line GL2, GL4, . . . , GLn according to the output signal of the previous stage 2622 to 262*m*. The first stage 2621 supplies the second gate shift clock CLK2 of the second voltage V2 provided from the input line of the second gate shift clock CLK2 to the second gate line GL2 according to the gate start pulse GSP from the timing controller 222.

The second gate driver circuit 260 sequentially supplies the gate pulses having the second voltage V2, which are phase-delayed by one horizontal period according to the second and fourth gate shift clocks CLK2 and CLK4 having the second voltage V2 converted by the voltage converter 264, to the even gate lines (GL2, GL4, . . . , GLn).

Figure 13:
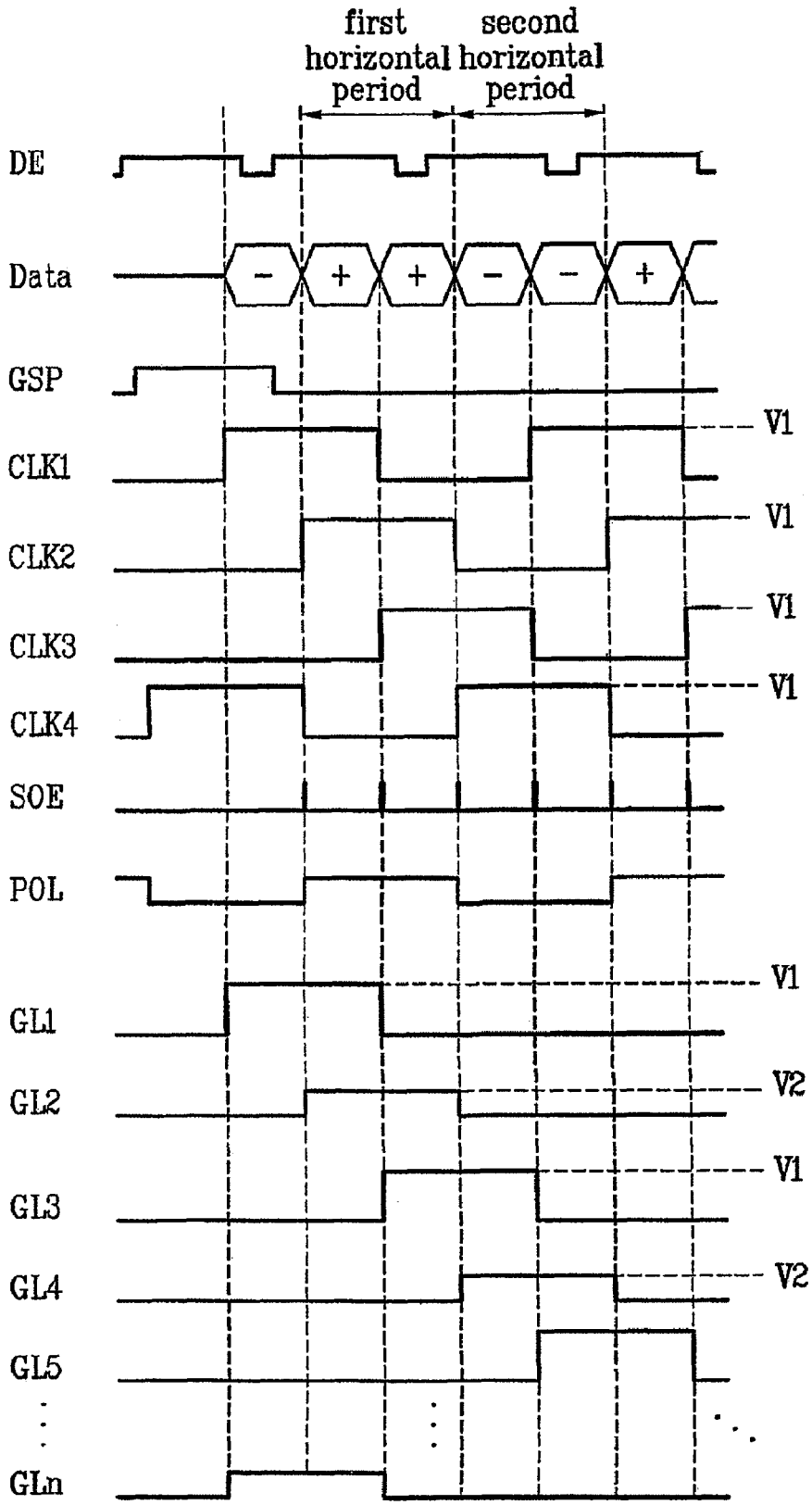
FIG. 13 is a waveform diagram illustrating a driving method for the liquid crystal display device according to the fourth embodiment of the present invention.

FIG. 13 is a waveform diagram illustrating a driving method for the liquid crystal display device according to the fourth embodiment of the present invention, which illustrates a drive waveform outputted from the timing controller and a gate pulse supplied to the gate line.

Figure 14:
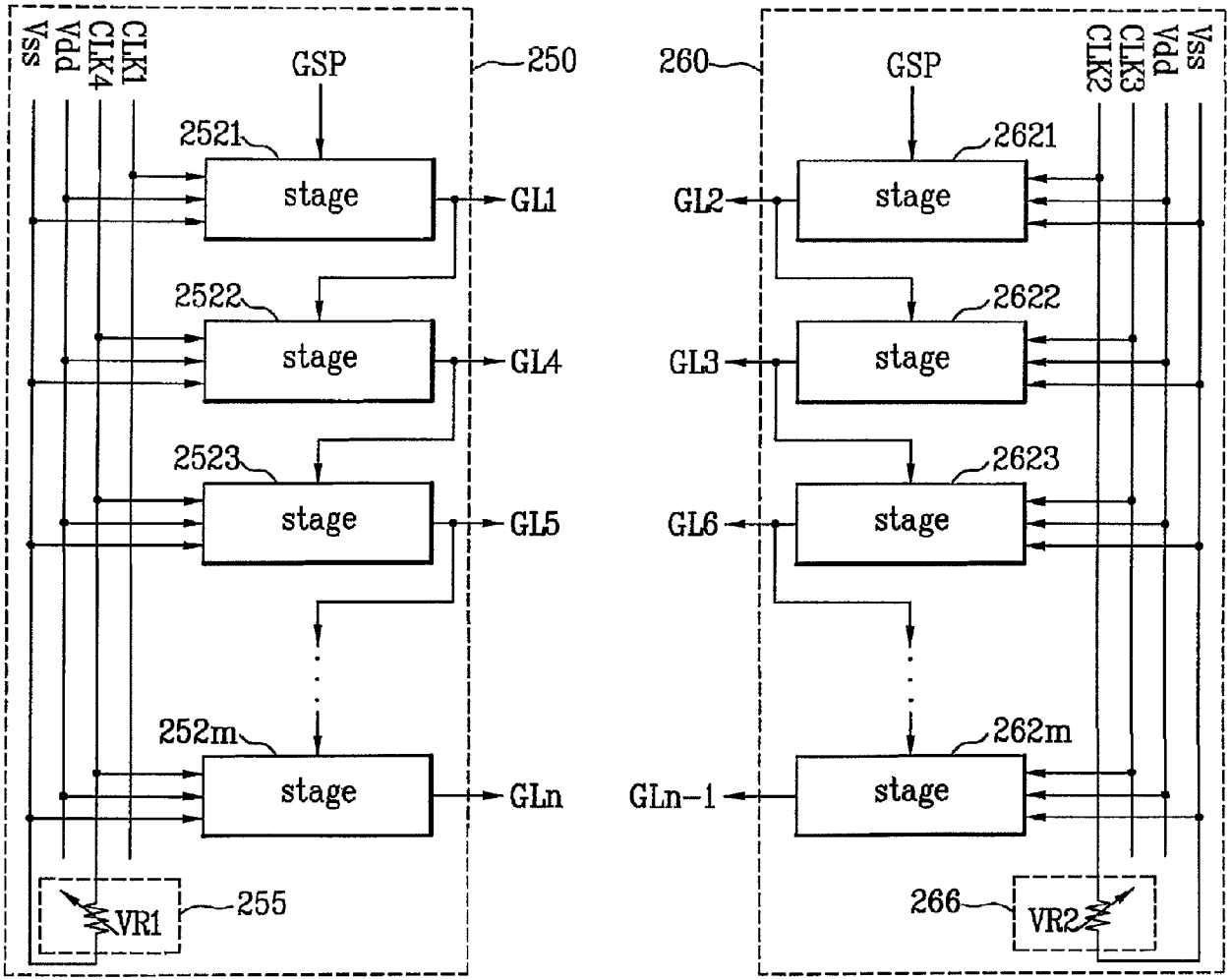
FIG. 14 illustrates a gate driver in an apparatus for driving a liquid crystal display device according to the fifth embodiment of the present invention.

On explaining FIG. 14 in connection with FIG. 6 and FIG. 12, first, in the apparatus for driving the liquid crystal display device according to the fourth embodiment of the present invention, the timing controller 222 outputs gate and data control signals of the same waveform as shown in FIG. 9 except it outputs the first to fourth gate shift clocks CLK1 to CLK4 of the first voltage V1. That is, the timing controller 222 supplies the first to fourth gate shift clocks CLK1 to CLK4 having the first voltage V1, which are sequentially phase-delayed for being overlapped by ½ horizontal period according to vertical and horizontal synchronous signals, to the first and second gate driver circuits 250 and 260. The first and third gate shift clocks CLK1 and CLK3 are provided to the first gate driver circuit 250, and the second and fourth gate shift clocks CLK2 and CLK4 are provided to the second gate driver circuit 260.

In the apparatus and method for driving the liquid crystal display device according to the fourth embodiment of the present invention, vertical dimming, which arises during line inversion driving of the image display 212, can be minimized by supplying the gate pulses having different voltages V1 and V2 to the odd-column pixels Po and the even-column pixels Pe, respectively, with the voltage converter 264 provided in the second gate driver circuit 260.

FIG. 14 illustrates first and second gate driver circuits 250 and 260 in an apparatus for driving a liquid crystal display device according to the fifth embodiment of the present invention.

Referring to FIG. 14, in the apparatus for driving the liquid crystal display device according to the fifth embodiment of the present invention, the timing controller 222 outputs gate and data control signals of the same waveform as shown in FIG. 9 except it outputs the first to fourth gate shift clocks CLK1 to CLK4 of the first voltage V1.

The first gate driver circuit 250 includes first and fourth gate shift clock CLK1 and CLK4 input lines of the first voltage V1, driving voltage Vdd and base voltage Vss input lines, a gate start pulse GSP input line, a first voltage converter 255 connected between the fourth gate shift clock input line and the base voltage input line to convert the fourth gate shift clock CLK4 of the first voltage to the second voltage V2, and 'm' stages (m, positive number of n/2) 2521 to 252*m* connected with the respective input lines for supplying the gate pulse of the first voltage V1 to the '4i+1' ('i' corresponds to the positive number of 0 to 4/n) gate line (GL1, GL5 . . . ), and for supplying the gate pulse of the second voltage to the '4i+4' gate line (GL4, GL8 . . . ).

The first and fourth gate shift clocks CLK1 and CLK4 having the first voltage V1 are sequentially phase-delayed by one horizontal period from the timing controller 222, and are sequentially supplied to one end of the first and fourth gate shift clock CLK1 and CLK4 input lines.

The first voltage converter 255 includes a first variable resistor VR1, wherein the first variable resistor VR1 is connected between the other end of the fourth gate shift clock input line and the base voltage input line. The first variable resistor VR1 converts the fourth gate shift clock CLK4 having the first voltage inputted to the fourth gate shift clock input line to the second voltage V2, which is lower than the first voltage V1.

Except the first stage 2521, each stage 2521 to 252*m* supplies the clock signal CLK1 and CLK4 of the first or second voltage V1 or V2 provided from one of the first and fourth gate shift clock input lines to the corresponding gate line GL1, GL4, . . . , GLn according to the output signal of the previous stage 2522 to 252*m*.

That is, the odd stage (2521, 2523, . . . , 252*m*−1) sequentially supplies the first gate shift clock CLK1 of the first voltage V1 provided from the first gate shift clock input line to the '4i+1' gate line (GL1, GL5 . . . ) according to the gate start pulse GSP of the timing controller 222. The first stage 2521 supplies the first gate shift clock CLK1 of the first voltage V1 provided from the first gate shift clock CLK1 input line to the first gate line GL1 according to the gate start pulse GSP from the timing controller 222.

The even stage (2522, 2524, . . . , 252*m*) sequentially supplies the fourth gate shift clock CLK4 of the second voltage V2 from the fourth gate shift clock input line, which is voltage-dropped by the first voltage converter 255, to the '4i+4' gate line (GL4, GL8, . . . ).

The second gate driver circuit 260 includes second and third gate shift clock CLK2 and CLK3 input lines of the first voltage V1, driving voltage Vdd and base voltage Vss input lines, a gate start pulse GSP input line, and a second voltage converter 266 connected between the second gate shift clock input line and the base voltage input line to convert the second gate shift clock CLK4 of the first voltage to the second voltage V2, and 'm' stages (m, positive number of n/2) 2621 to 262*m* connected with the respective input lines for supplying the gate pulse of the second voltage V2 to the '4i+2' gate line (GL2, GL6 . . . ), and for supplying the gate pulse of the first voltage to the '4i+3' gate line (GL3, GL7 . . . ).

The second and third gate shift clocks CLK2 and CLK3 having the first voltage V1 are sequentially phase-delayed by one horizontal period from the timing controller 222, and are sequentially supplied to one end of the second and third gate shift clock CLK2 and CLK3 input lines.

The second voltage converter 266 includes a second variable resistor VR2, wherein the first variable resistor VR2 is connected between the other end of the second gate shift clock input line and the base voltage input line. The second variable resistor VR2 converts the fourth gate shift clock CLK2 having the first voltage inputted to the second gate shift clock input line to the second voltage V2, which is lower than the first voltage V1.

Except the first stage 2621, each stage 2621 to 262*m* supplies the clock signal CLK2 and CLK3 of the first or second voltage V1 or V2 provided from one of the second and third gate shift clock input lines to the corresponding gate line GL2, GL3, . . . , GLn−1 according to the output signal of the previous stage 2622 to 262*m*.

That is, the odd stage (2621, 2623, . . . , 262*m*−1) sequentially supplies the second gate shift clock CLK2 of the second voltage V2 provided from the second gate shift clock input line to the '4i+2' gate line (GL2, GL6, . . . ) according to the gate start pulse GSP of the timing controller 222. The first stage 2621 supplies the second gate shift clock CLK2 of the second voltage V2 provided from the second gate shift clock CLK2 input line to the second gate line GL2 according to the gate start pulse GSP from the timing controller 222.

The even stage (2622, 2624, . . . , 262*m*) sequentially supplies the third gate shift clock CLK3 of the first voltage V1 from the third gate shift clock input line of the timing controller 222 to the '4i+3' gate line (GL3, GL7 . . . ).

In the apparatus and method for driving a liquid crystal display device according to the fifth embodiment of the present invention, vertical dimming, which arises during line inversion driving of the image display 212, can be minimized by supplying the gate pulses having the different voltages V1 and V2 to the odd-column pixels Po and the even-column pixels Pe, respectively, with the voltage converters 255 and 266 provided in the first and second gate driver circuits 250 and 260.

In another apparatus for driving a liquid crystal display device according to the preferred embodiment of the present invention, a gate driver may be provided with a first gate driver circuit 250 and a second gate driver circuit 260, wherein the first gate driver circuit 250 generates gate pulses of a first voltage V1 and/or a second voltage V2 according to two gate shift clocks (CLK1, CLK2) (CLK1, CLK3) (CLK1, CLK4) (CLK2, CLK3) (CLK3, CLK4) among first to fourth gate shift clocks CLK1 to CLK4, and the second gate driver circuit 260 generates gate pulses of a first voltage V1 and/or a second voltage V2 according to two gate shift clocks (CLK3, CLK4) (CLK2, CLK4) (CLK2, CLK3) (CLK1, CLK4) (CLK1, CLK2) among first to fourth gate shift clocks CLK1 to CLK4. Thus, the gate driver according to another embodiment of the present invention supplies the gate pulses of the different voltages V1 and V2 to the odd-column pixels Po and the even-column pixels P3

Figure 15:
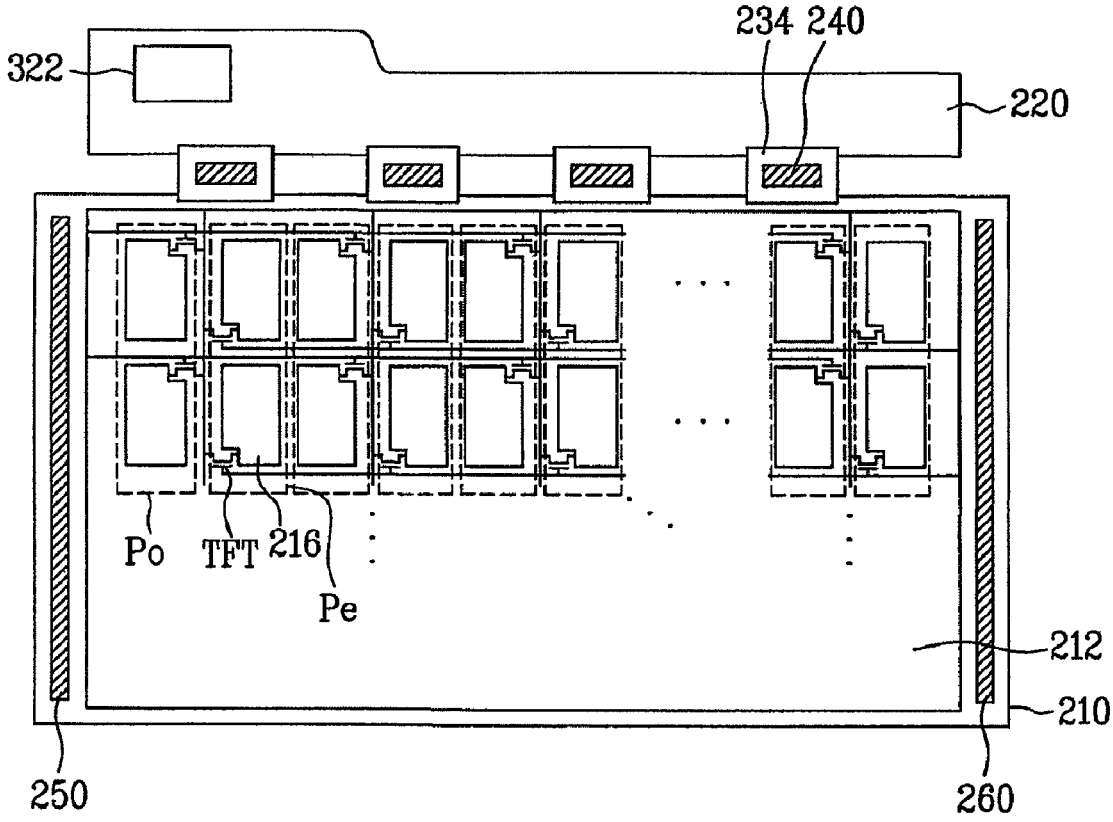
FIG. 15 illustrates an apparatus for driving a liquid crystal display device according to the sixth embodiment of the present invention.

FIG. 15 illustrates an apparatus for driving a liquid crystal display device according to the sixth embodiment of the present invention.

Referring to FIG. 15, the apparatus for driving a liquid crystal display device comprises a liquid crystal panel 210. The liquid crystal panel 210 comprises an image display 212 including a plurality of data lines DL and a plurality of gate lines GL. The image display 212 also includes odd-column pixels Po each of which is connected to a first side of one of the data lines DL and connected to one of the odd gate lines GL1, GL3, . . . , GLn−1, and even-column pixels Pe each of which is connected to a second side of one of the data lines and connected to one of the even gate lines GL2, GL4, . . . , GLn. The driving apparatus also comprises a gate driver for providing first and second gate pulses having different widths and voltages to the odd gate lines GL1, GL3, . . . , GL n−1 and the even gate lines GL2, GL4, . . . , GLn, respectively, and a plurality of data integrated circuits 240 for providing data voltages having a positive or negative polarity to the data lines DL, respectively. The driving apparatus further comprises a timing controller 322 for performing supply and control of data signals to provide the data voltages to the data lines DL, and for controlling the gate driver.

Except the timing controller 322 and the gate driver, the driving apparatus according to the sixth embodiment of the present invention is identical in structure with the driving apparatus according to the second embodiment of the present invention. Thus, in the driving apparatus according to the sixth embodiment of the present invention, the other parts except the timing controller and the gate driver will be explained with reference to FIG. 6.

Figure 17:
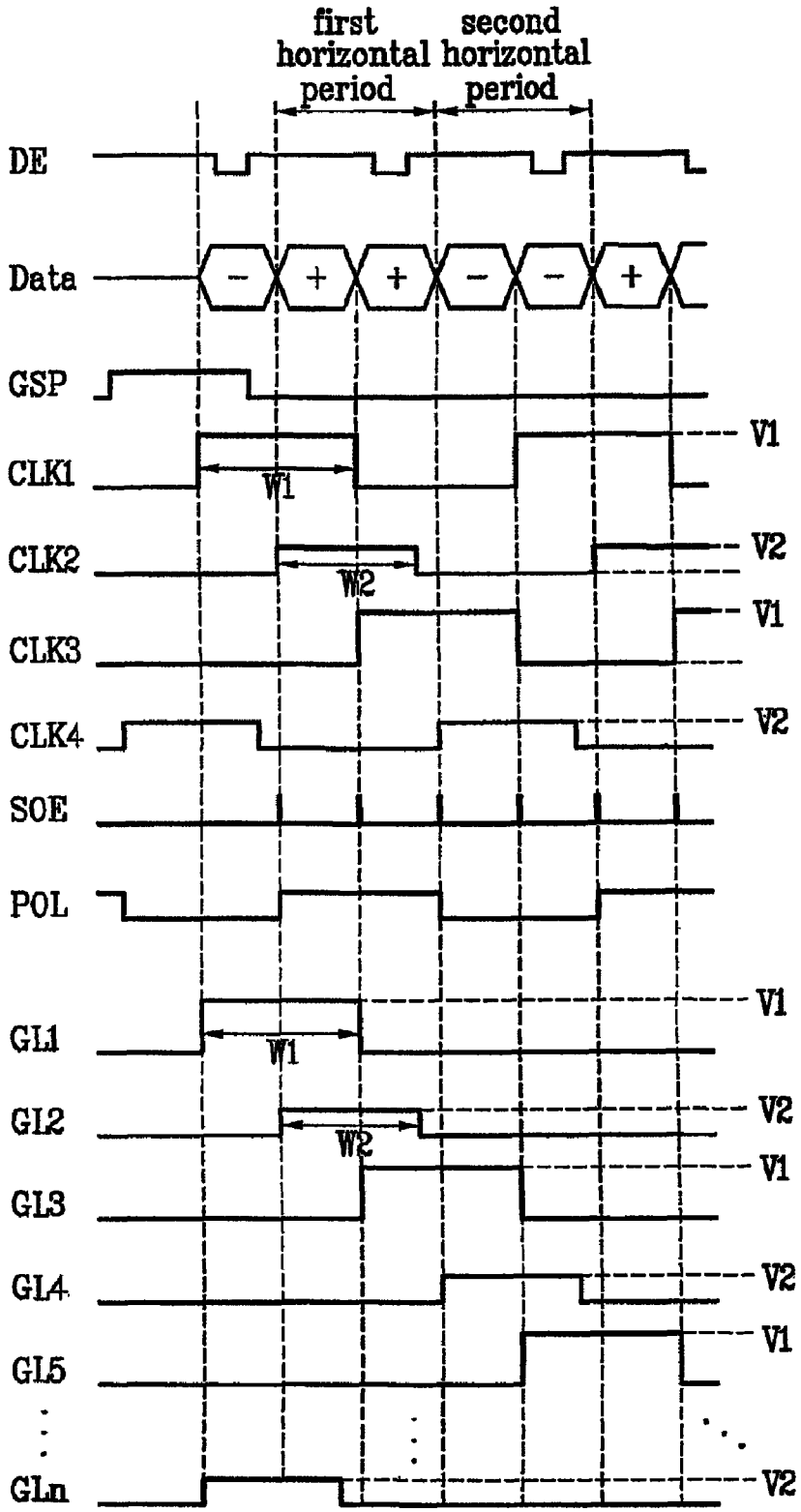
FIG. 17 is a waveform diagram illustrating a driving method for the liquid crystal display device according to the sixth embodiment of the present invention.

Using the vertical and horizontal synchronous signals and the data enable signal, the timing controller 322 generates first and third gate shift clocks CLK1 and CLK3 having a first pulse width W1 and a first voltage V1, and second and fourth gate shift clocks CLK2 and CLK4 having a second pulse width W2 and a second voltage V2, as shown in FIG. 17. The first width W1 is set to be wider than the second width W2, and the voltage V1 is set to be higher than the second voltage V2.

As shown in FIG. 15, the gate driver further includes first and second gate driver circuits 250 and 260 for providing the first and second gate pulses having the different widths (W1 and W2) and voltages (V1 and V2) to the odd-column pixels Po and the even-column pixels Pe.

The first gate driver circuit 250 sequentially supplies the gate pulses having the first width W1 and the first voltage V1 to the gate lines (GL1, GL3, GL5, . . . ) connected with the odd-column pixels Po according to the first and third gate shift clocks CLK1 and CLK3 having the first width W1 and the first voltage V1.

The first gate driver circuit 250 includes first and third gate shift clock (CLK1 and CLK3) input lines of the first width W1 and the first voltage V1, driving voltage Vdd and base voltage Vss input lines, a gate start pulse GSP input line, and 'm' stages (m, positive number of n/2) 2521 to 252*m* connected with the respective input lines for supplying the gate pulses of the first width W1 and the first voltage V1 to the odd gate lines (GL1, GL3, . . . , GLn−1). The first gate driver circuit 250 is directly formed on the liquid crystal panel 210.

The second gate driver circuit 260 sequentially supplies the gate pulses having the second width W2 and the second voltage V2 to the gate lines (GL2, GL4, GL6, . . . ) connected with the even-column pixels Pe according to the second and fourth gate shift clocks CLK2 and CLK4 having the second width W2 and the second voltage V2.

The second gate driver circuit 260 includes second and fourth gate shift clock (CLK2 and CLK4) input lines of the second width W2 and the second voltage V2, driving voltage Vdd and base voltage Vss input lines, a gate start pulse GSP input line, and 'm' stages (m, positive number of n/2) 2621 to 262*m* connected with the respective input lines for supplying the gate pulses of the second width W2 and the second voltage V2 to the even gate lines (GL2, GL4, . . . , GLn). The second gate driver circuit 260 is directly formed on the liquid crystal panel 210.

FIG. 17 is a waveform diagram illustrating a driving method for the liquid crystal display device according to the sixth embodiment of the present invention.

Figure 16:
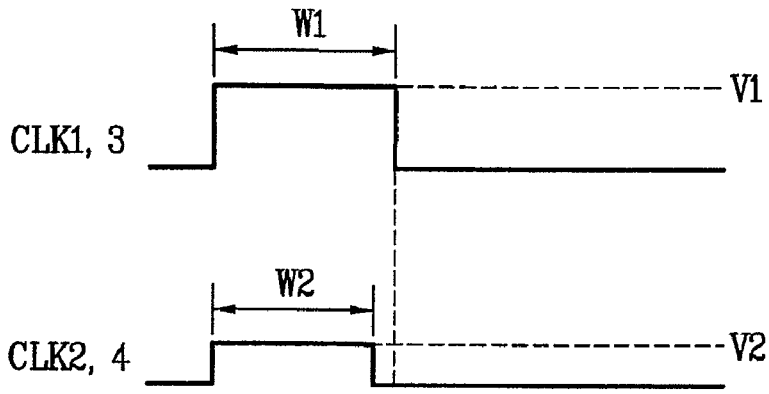
FIG. 16 is a waveform diagram illustrating a first to fourth gate shift clocks generated from a timing controller of FIG. 15.

On explaining FIG. 17 in connection with FIG. 15 and FIG. 16, the driving apparatus and method according to the sixth embodiment of the present invention are identical to the driving apparatus and method according to the second embodiment of the present invention except that the gate pulses having the different widths (W1 and W2) and voltages (V1 and V2) are respectively provided to the odd-column pixels Po and even-column pixels Pe.

In the apparatus and method for driving the liquid crystal display device according to the sixth embodiment of the present invention, vertical dimming, which arises during line inversion driving of the image display 212, can be minimized by supplying the gate pulses having different widths (W1 and W2) and voltages (V1 and V2) to the odd-column pixels Po and the even-column pixels Pe, respectively, with the first and third gate shift clocks (CLK1 and CLK3) of the first width W1 and the first voltage V1 and the second and fourth gate shift clocks (CLK2 and CLK4) of the second width W2 and the second voltage V2.

Figure 18:
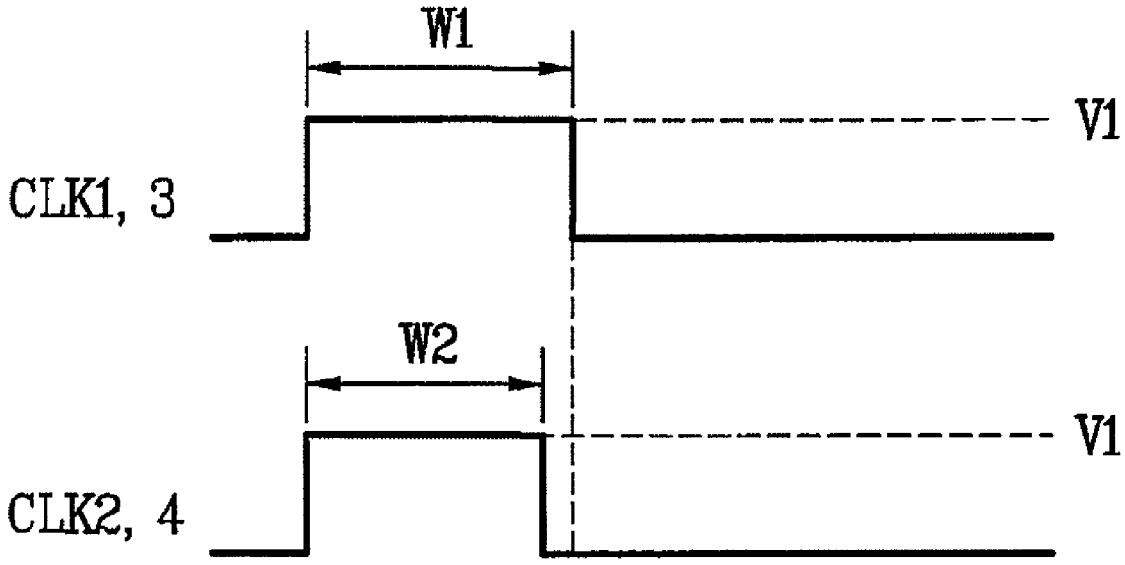
FIG. 18 is a waveform diagram illustrating a first to fourth gate shift clocks according to the seventh embodiment of the present invention generated from a timing controller of FIG. 15.

In an apparatus for driving a liquid crystal display device according to the seventh embodiment of the present invention, as shown in FIG. 18, a timing controller 322 generates first and third gate shift clocks CLK1 and CLK3 having a first width W1 and a first voltage V1, and second and fourth gate shift clocks CLK2 and CLK4 having a second width W2 and a first voltage V1. Then, the first to fourth gate shift clocks CLK1 to CLK4 generated in the timing controller 322 are provided to a gate driver. The first width W1 is set to be wider than the second width W2.

In the driving apparatus according to the seventh embodiment of the present invention, the gate driver includes first and second gate driver circuits 250 and 260 for providing the gate pulses having the different widths (W1 and W2) and voltages (V1 and V2) to the odd-column pixels Po and even-column pixels Pe.

The first gate driver circuit 250 sequentially supplies the gate pulses having the first width W1 and the first voltage V1 to the gate lines (GL1, GL3, GL5 . . . ) connected with the odd-column pixels Po according to the first and third gate shift clocks CLK1 and CLK3 having the first width W1 and the first voltage V1.

The first gate driver circuit 250 includes first and third gate shift clock (CLK1 and CLK3) input lines of the first width W1 and the first voltage V1, driving voltage Vdd and base voltage Vss input lines, a gate start pulse GSP input line, and 'm' stages (m, positive number of n/2) 2521 to 252*m* connected with the respective input lines for supplying the gate pulses of the first width W1 and the first voltage V1 to the odd gate lines (GL1, GL3, . . . , GLn−1). The first gate driver circuit 250 is directly formed on the liquid crystal panel 210.

The second gate driver circuit 260 converts the second and fourth gate shift clocks CLK2 and CLK4 from the second width W2 and the first voltage V1 to the second width W2 and the second voltage V2. Then, the gate pulses of the second width W2 and the second voltage V2 are sequentially provided to the gate lines (GL2, GL4, GL6, . . . ) connected with the even-column pixels Pe.

The second gate driver circuit 260 includes the second and fourth gate shift clock (CLK2 and CLK4) input lines of the first width W1 and the first voltage V1, driving voltage Vdd and base voltage Vss input lines, a gate start pulse GSP input line, a voltage converter 264 connected between each of the second and fourth gate shift clock (CLK2 and CLK4) input lines and the base voltage (Vss) input line for converting the second and fourth gate shift clocks (CLK2 and CLK4) from the first width W1 and the first voltage V1 to the first width W1 and the second voltage V2, and 'm' stages (m, positive number of n/2) 2621 to 262*m* connected with the respective input lines for supplying the gate pulses of the first width W1 and the second voltage V2 to the even gate lines (GL2, GL4, . . . , GLn). The second gate driver circuit 260 is directly formed on the liquid crystal panel 210.

In the apparatus and method for driving the liquid crystal display device according to the seventh embodiment of the present invention, vertical dimming, which arises during line inversion driving of the image display 212, can be minimized by supplying the gate pulses having the different widths (W1 and W2) and voltages (V1 and V2) to the odd-column pixels Po and the even-column pixels Pe, respectively, with the first and third gate shift clocks (CLK1 and CLK3) of the first width W1 and the first voltage V1 and the second and fourth gate shift clocks (CLK2 and CLK4) of the second width W2 and the first voltage V1.

Figure 19:
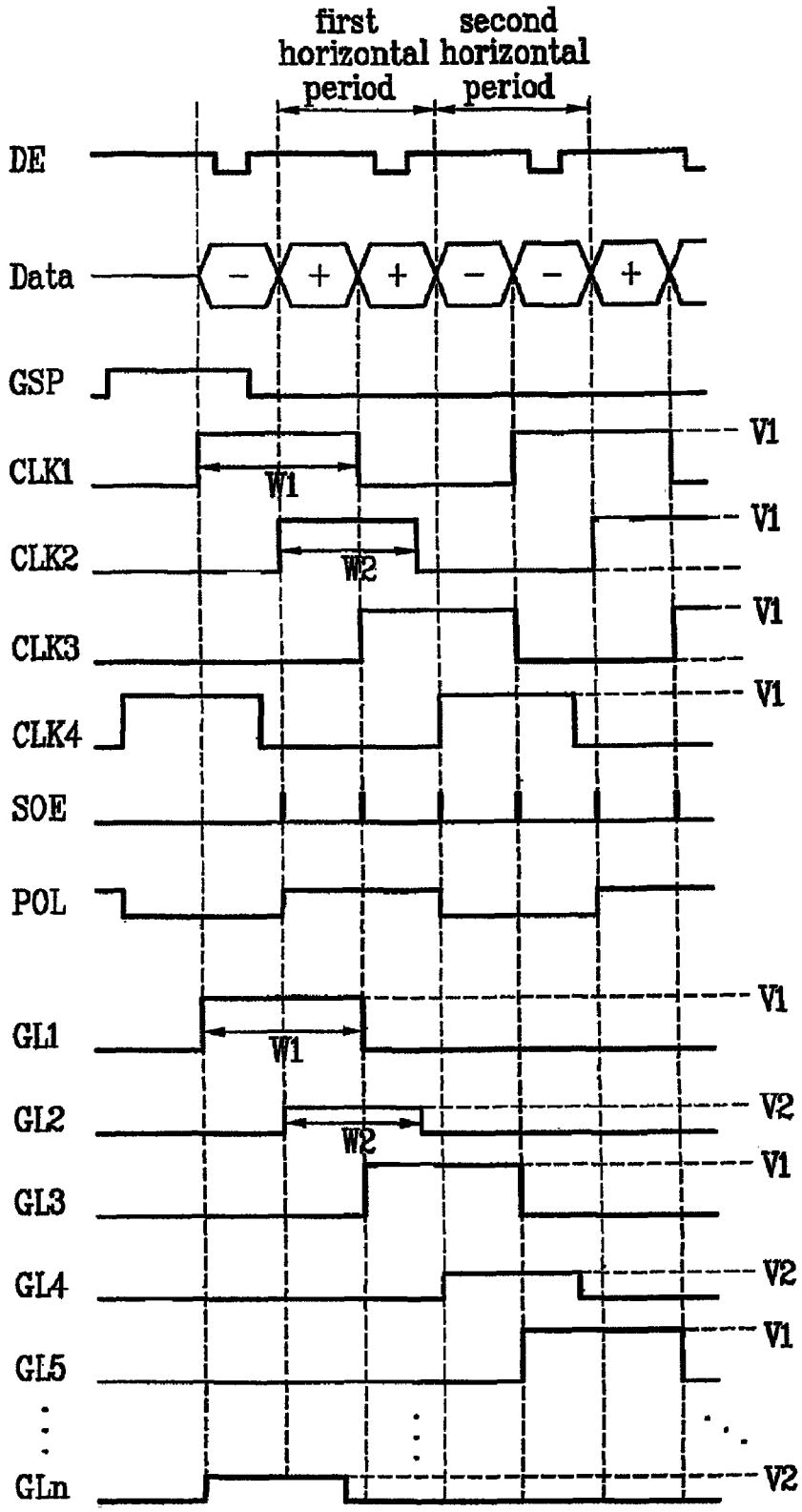
FIG. 19 is a waveform diagram illustrating a driving method for the liquid crystal display device according to the seventh embodiment of the present invention.

FIG. 19 is a waveform diagram illustrating a driving method for the liquid crystal display device according to the seventh embodiment of the present invention.

On explaining FIG. 19 in connection with FIG. 12 and FIG. 18, the driving apparatus and method according to the seventh embodiment of the present invention are identical to the driving apparatus and method according to the sixth embodiment in that the gate pulses having the different widths (W1 and W2) and voltages (V1 and V2) are provided to the odd-column pixels Po and even-column pixels Pe.

In the driving apparatus and method according to the seventh embodiment of the present invention, vertical dimming, which arises during line inversion driving of the image display 212, can be minimized by supplying the gate pulses having the different widths (W1 and W2) and voltages (V1 and V2) to the odd-column pixels Po and even-column pixels Pe, respectively, with the first and third gate shift clocks CLK1 and CLK3 of the first width W1 and the first voltage V1 and the second and fourth gate shift clocks CLK2 and CLK4 of the second width W2 and the first voltage V1.

In the meantime, in case of the driving apparatus according to the seventh embodiment of the present invention, it is possible to provide the gate driver having the structure of FIG. 14.

In the driving apparatus according to the sixth and seventh embodiments of the present invention, the gate driver provides the different gate pulses to the odd-column pixels Po and the even-column pixels Pe with at least two gate shift clocks according to the connection structure between each pixel 216 and gate line.

In the apparatus and method for driving the liquid crystal display device, vertical dimming can be minimized to enhance picture quality. During line inversion driving, gate pulses having different widths and/or voltages are applied to the odd-column pixels and the even-column pixels with respect to each data line. The odd-column pixels and the even-column pixels are precharged with voltages having different polarities. Gate pulses having different widths and/or voltages make the effective charge times of the odd-column pixels and the even-column pixels different, minimizing vertical dimming. As indicated, any combination of altering the width and voltage of the gate pulse during the precharging period and charging period may be used to reduce the disparity between the charging of the odd-column pixels and the even-column pixels.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for driving a display device having pixels, the method comprising:

precharging a first set of pixels with a first precharge voltage of a first polarity using first gate pulses and a second set of pixels with a second precharge voltage of a second polarity using second gate pulses; and charging the first and second set of pixels with a data voltage of a second polarity using the first and second gate pulses, respectively, the first and second gate pulses having at least one of different widths or amplitudes;

supplying the first gate pulses to the first set of pixels using a first gate driver and the second gate pulses to the second set of pixels using a second gate driver;

converting the first gate pulses into the second gate pulses using a resistor connected between input lines carrying the first gate pulses and base voltage input lines.

2. The method as set forth in claim 1, wherein the first set of pixels are odd-column pixels and the second set of pixels are even-column pixels.

3. The method as set forth in claim 1, wherein the first and second gate pulses have different widths.

4. The method as set forth in claim 3, wherein the first and second gate pulses have different amplitudes.

5. The method as set forth in claim 4, further comprising generating the first and second gate pulses using first and second gate clock signals having different widths and different amplitudes.

6. The method as set forth in claim 1, wherein the first and second gate pulses have different amplitudes.

7. The method as set forth in claim 6, wherein the first and second gate pulses have the same width.

8. The method as set forth in claim 7, further comprising generating the first and second gate pulses using first and second gate clock signals having the same width but different amplitudes.

9. A method for driving a display device having pixels, the method comprising:

precharging a first set of pixels with a first precharge voltage of a first polarity using first gate pulses and a second set of pixels with a second precharge voltage of a second polarity using second gate pulses; and charging the first and second set of pixels with a data voltage of a second polarity using the first and second gate pulses, respectively, the first and second gate pulses having at least one of different widths or amplitudes;

supplying the first gate pulses to the first set of pixels using a first gate driver and a second gate driver and supplying the second gate pulses to the second set of pixels using the first and second gate drivers;

converting the first gate pulses into the second gate pulses using a resistor connected between input lines carrying the first gate pulses and base voltage input lines.

10. The method as set forth in claim 1, further comprising providing data voltages having different polarities to the first and second set of pixels at different times such that each row of pixels has the same polarity and adjacent rows of pixels have different polarities.

11. The method as set forth in claim 1, further comprising reversing the polarity of the data voltages applied to the first set of pixels and the second set of pixels every horizontal period.

* * * * *